US011112738B2

(12) United States Patent
Oh et al.

(10) Patent No.: US 11,112,738 B2
(45) Date of Patent: Sep. 7, 2021

(54) FIXING APPARATUS AND IMAGE FORMING APPARATUS HAVING THE SAME

(71) Applicant: HEWLETT-PACKARD DEVELOPMENT COMPANY, L.P., Spring, TX (US)

(72) Inventors: Hyun Taek Oh, Pangyo (KR); Jin Ho Park, Pangyo (KR)

(73) Assignee: HEWLETT-PACKARD DEVELOPMENT COMPANY, L.P., Spring, TX (US)

( * ) Notice: Subject to any disclaimer, the term of this patent is extended or adjusted under 35 U.S.C. 154(b) by 0 days.

(21) Appl. No.: 16/629,425

(22) PCT Filed: May 24, 2018

(86) PCT No.: PCT/KR2018/005910

§ 371 (c)(1),
(2) Date: Jan. 8, 2020

(87) PCT Pub. No.: WO2019/013445

PCT Pub. Date: Jan. 17, 2019

(65) Prior Publication Data

US 2020/0142337 A1 May 7, 2020

(30) Foreign Application Priority Data

Jul. 13, 2017 (KR) ..... 10-2017-0089134

(51) Int. Cl.

| | |
|---|---|
| ***G03G 15/00*** | (2006.01) |
| ***G03G 15/20*** | (2006.01) |
| ***G03G 21/16*** | (2006.01) |

(52) U.S. Cl.

CPC ..... *G03G 15/2053* (2013.01); *G03G 15/206* (2013.01); *G03G 15/2064* (2013.01); *G03G 21/1685* (2013.01); *G03G 2215/00143* (2013.01)

(58) Field of Classification Search

CPC ..... G03G 15/2053; G03G 15/206; G03G 15/2064; G03G 21/1685; G03G 2215/00143

See application file for complete search history.

(56) References Cited

U.S. PATENT DOCUMENTS

| | | | |
|---|---|---|---|
| 2006/0133869 A1 | 6/2006 | Sata | |
| 2008/0003028 A1 | 1/2008 | Kuroki et al. | |
| 2010/0158553 A1* | 6/2010 | Ueno | G03G 15/2064 399/67 |

(Continued)

FOREIGN PATENT DOCUMENTS

| | | |
|---|---|---|
| KR | 20-1998-0057918 U | 10/1998 |
| KR | 10-2009-0131492 A | 12/2009 |
| KR | 10-2014-0148230 A | 12/2014 |

*Primary Examiner* — Hoang X Ngo
(74) *Attorney, Agent, or Firm* — Staas & Halsey LLP

(57) ABSTRACT

A fixing apparatus includes a fixing belt, a pressing roller configured to form a nip by pressing the fixing belt and rotate the fixing belt, a bush configured to guide an edge of the fixing belt, and a meandering adjustment member configured to move a rotation shaft of the pressing roller in a direction perpendicular to an axis direction of the pressing roller. The fixing apparatus can be provided to an image forming apparatus.

15 Claims, 21 Drawing Sheets

(56) References Cited

U.S. PATENT DOCUMENTS

| | | | | |
|---|---|---|---|---|
| 2011/0200343 | A1 | 8/2011 | Matsumoto et al. | |
| 2012/0271447 | A1 | 10/2012 | Yoon et al. | |
| 2014/0285603 | A1 | 9/2014 | Kato | |
| 2014/0376978 | A1* | 12/2014 | Jeon | G03G 15/206 399/329 |

* cited by examiner

【Figure 1】
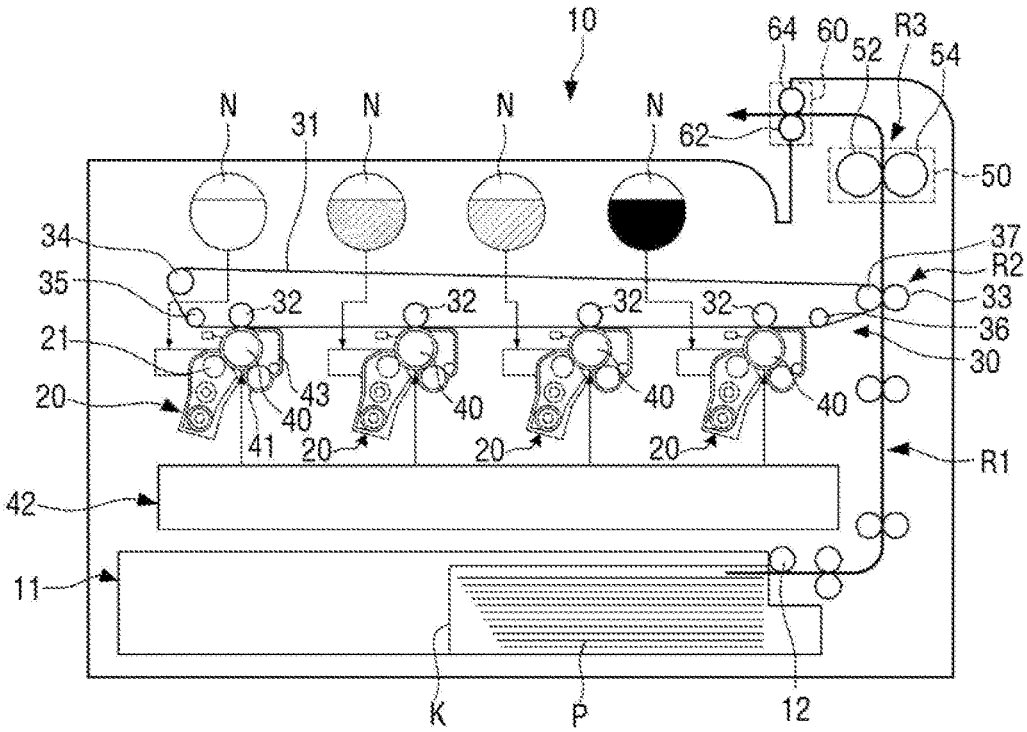
【Figure 2】
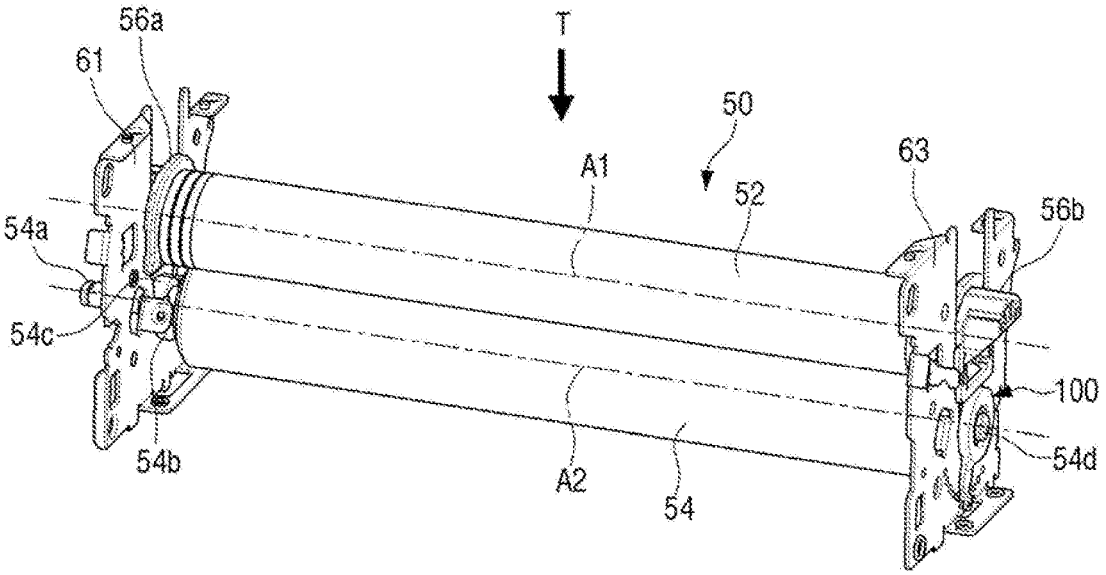

【Figure 3A】
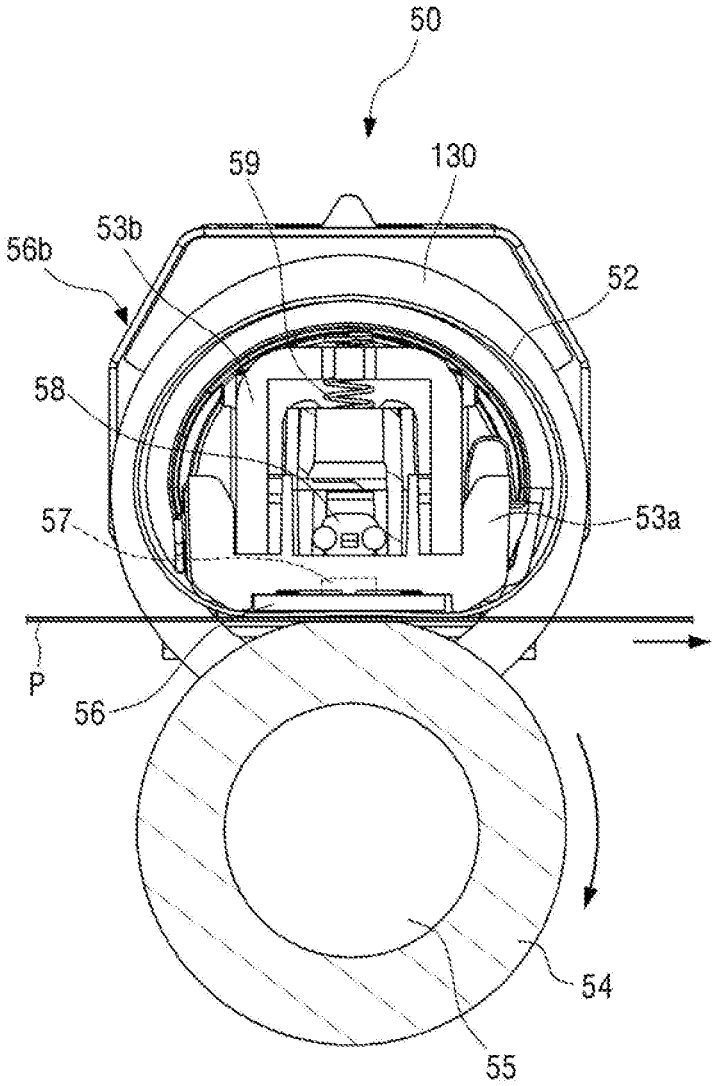

【Figure 3B】
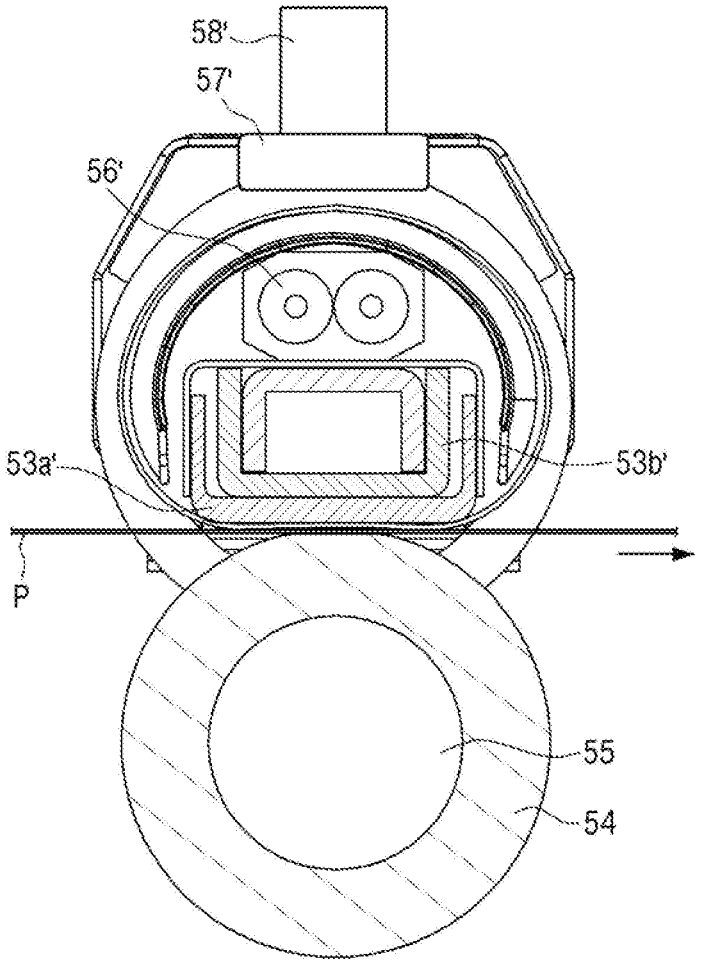

【Figure 4】
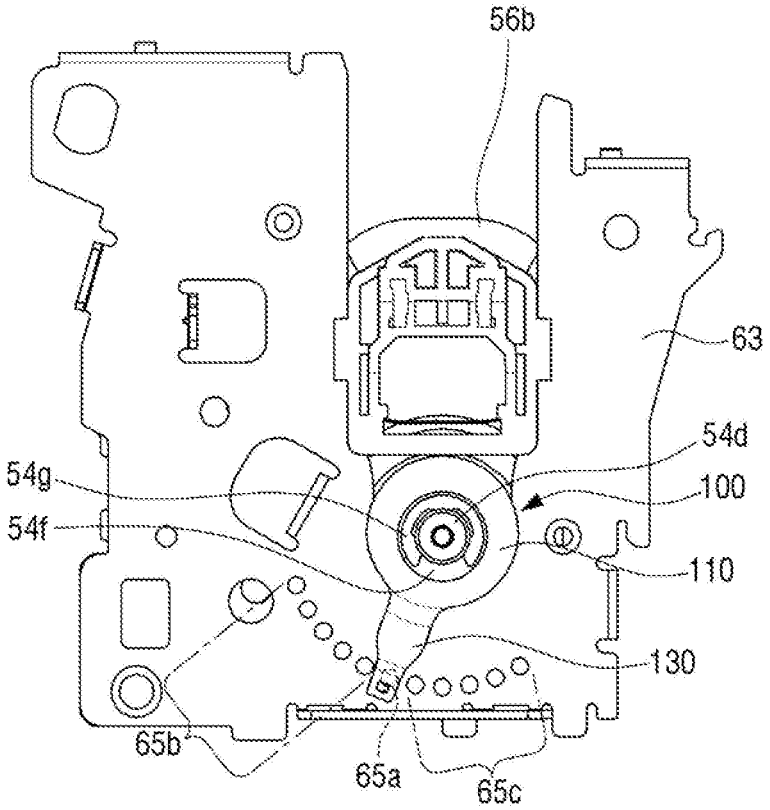

【Figure 5】
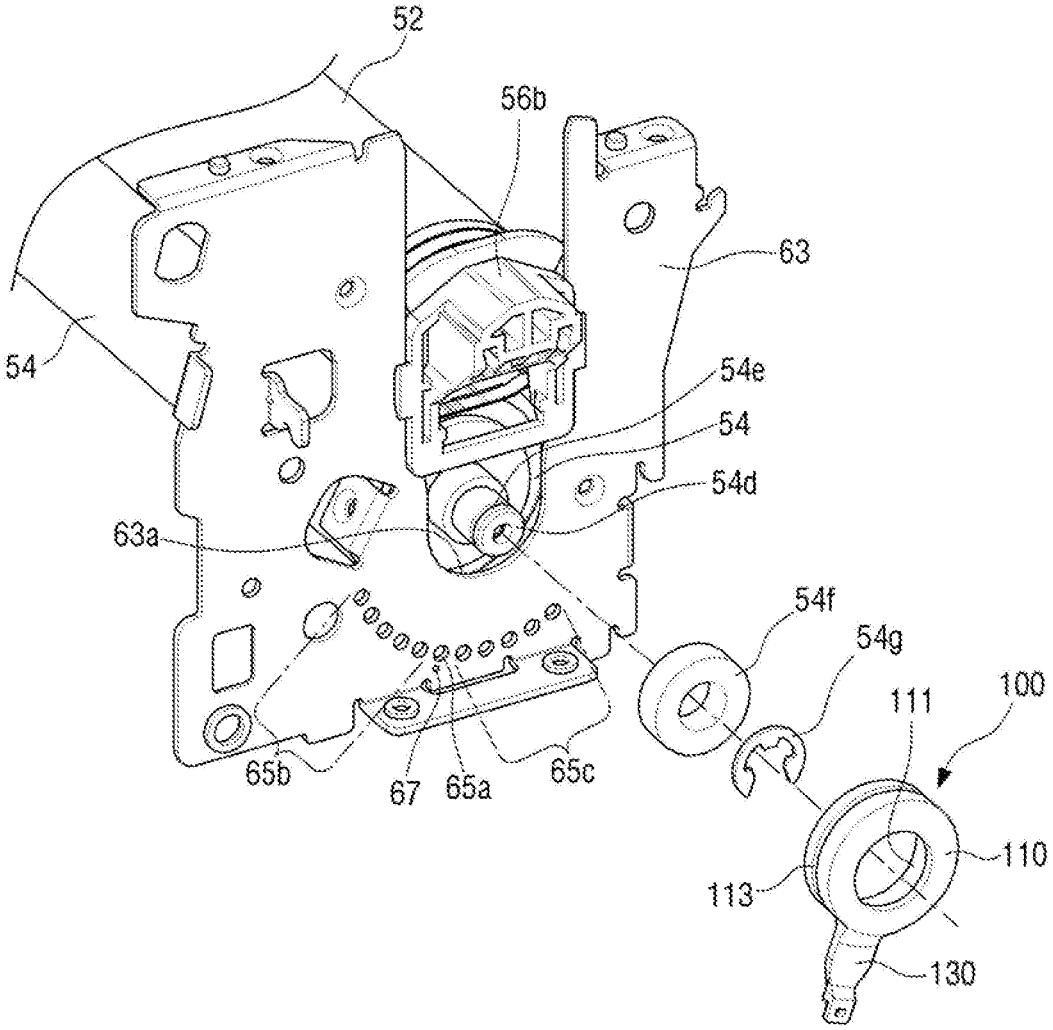

【Figure 6】
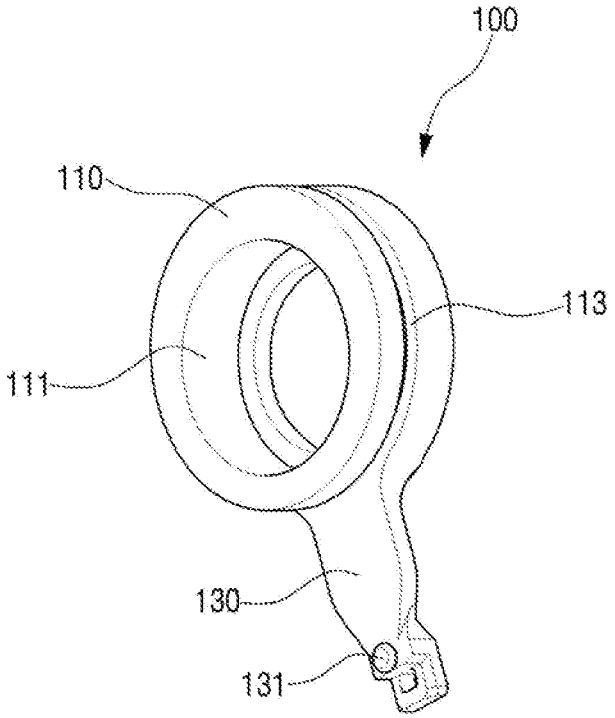

【Figure 7】
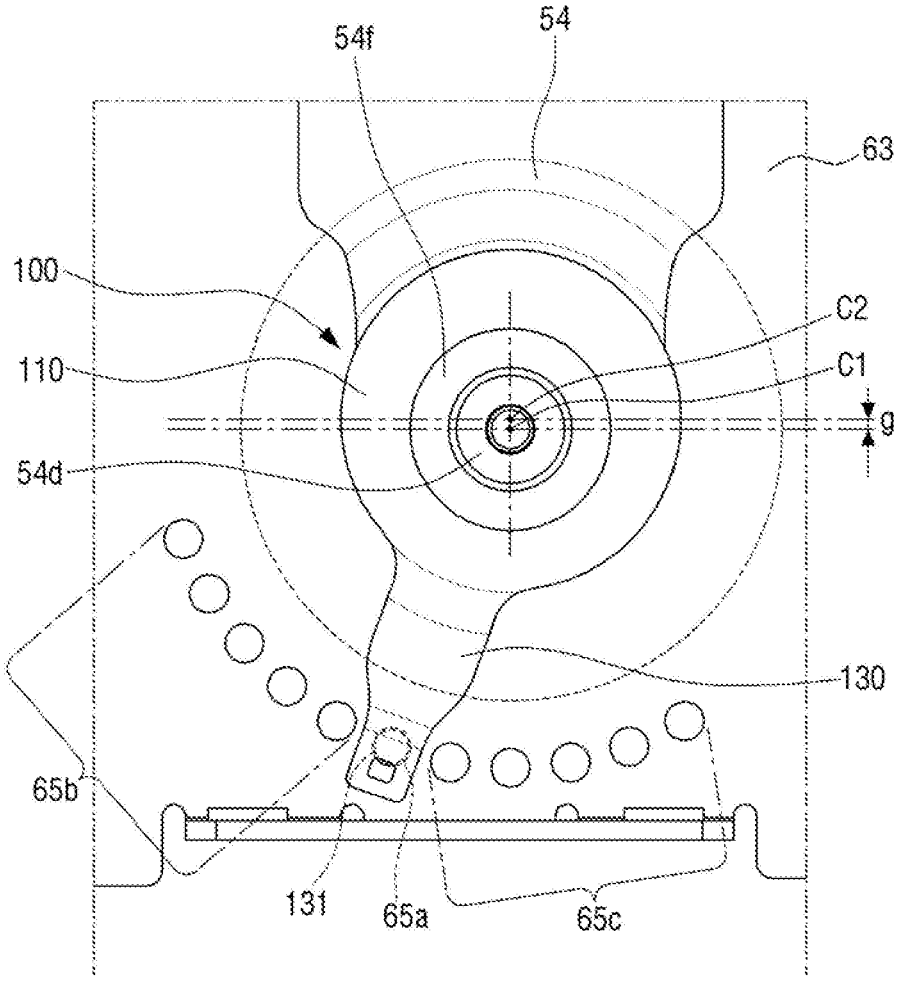

【Figure 8】
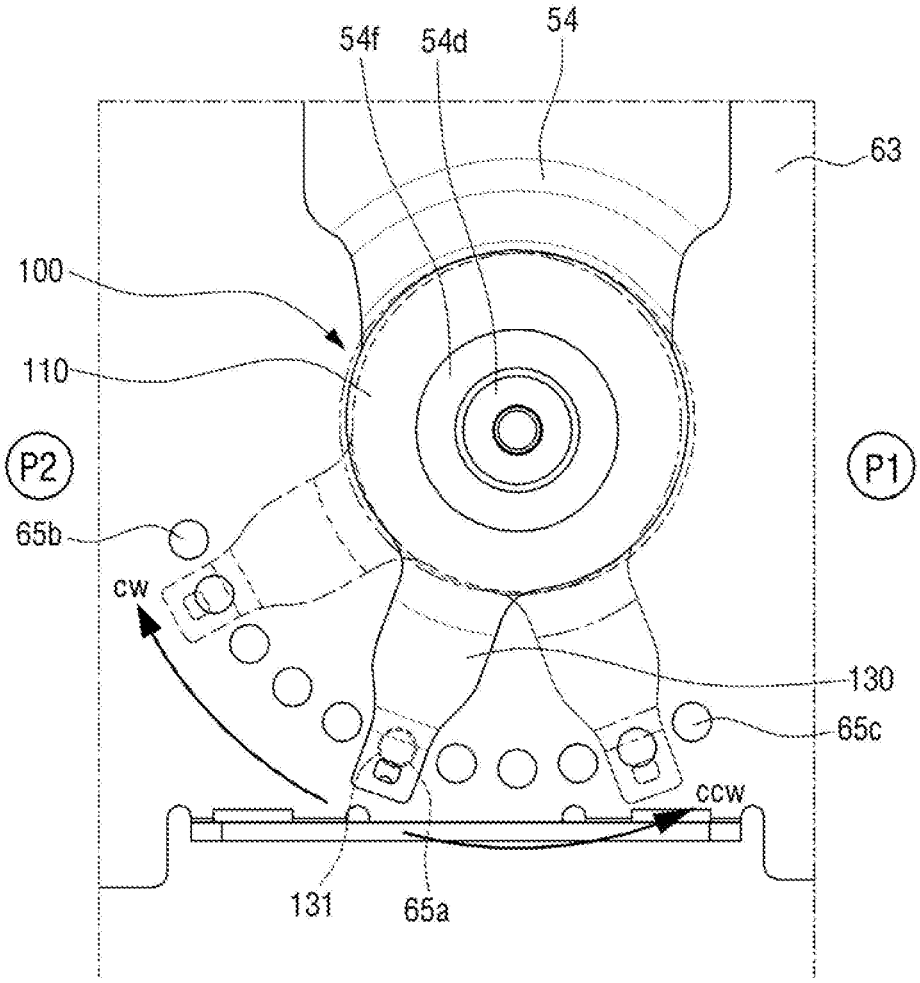
【Figure 9】
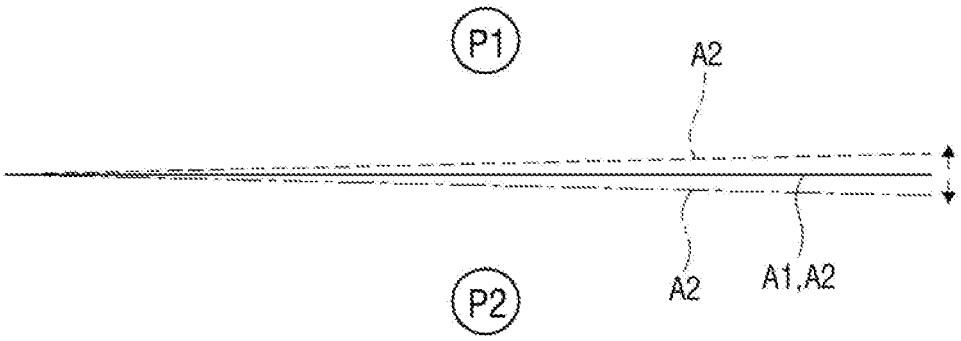

【Figure 10】
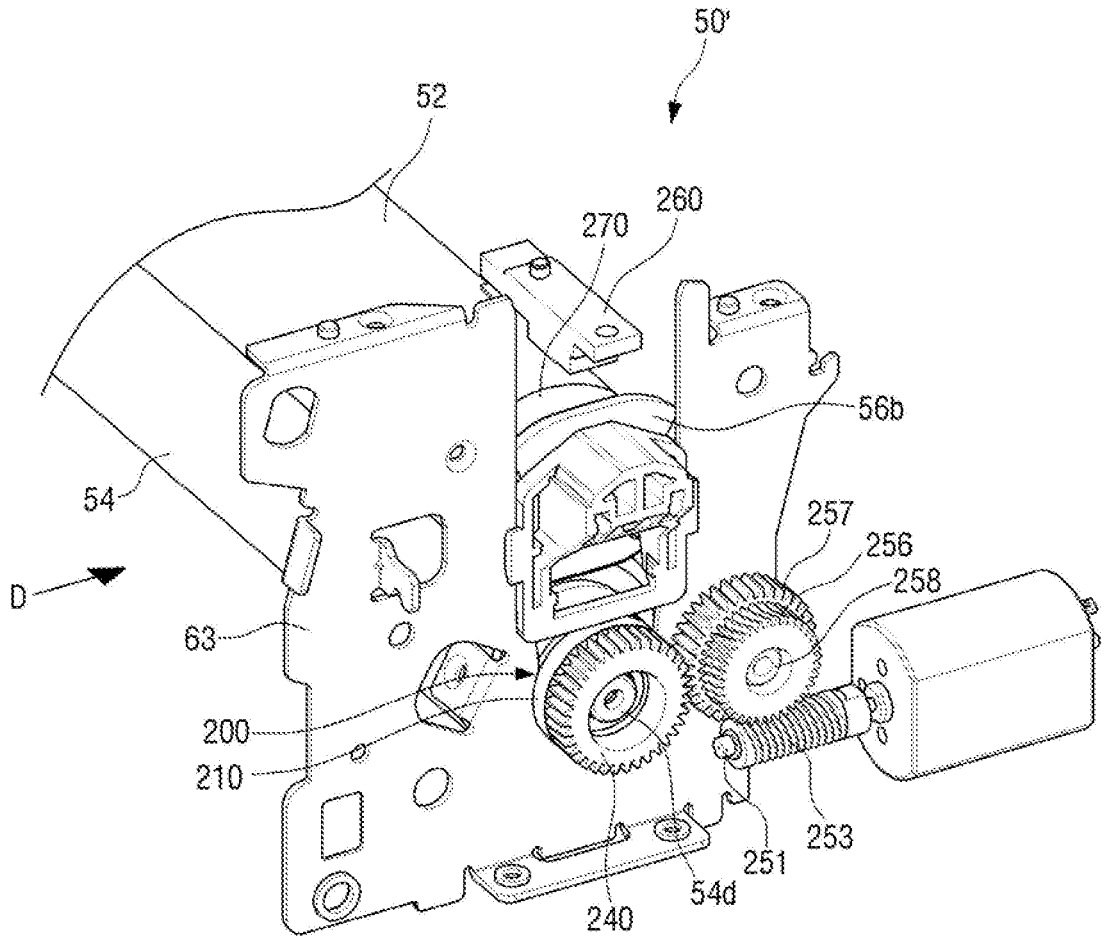

【Figure 11】
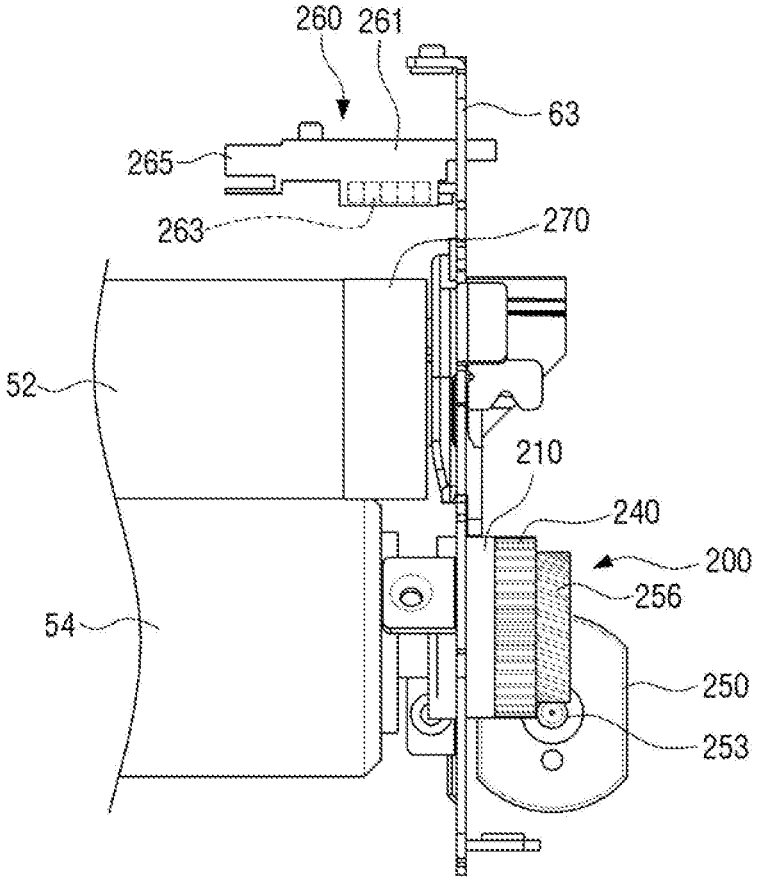

【Figure 12A】
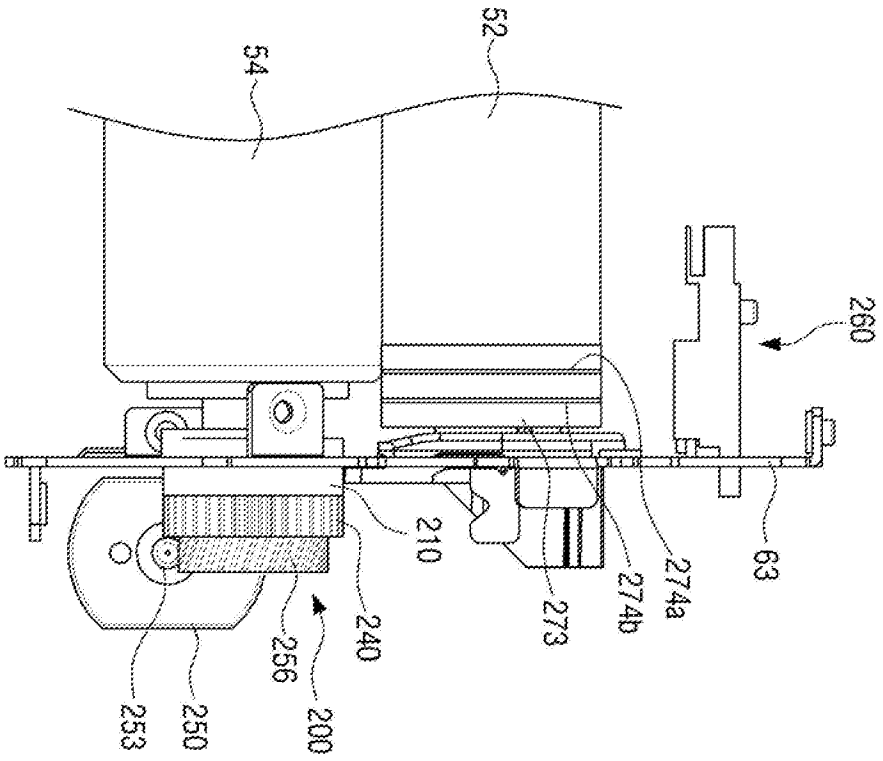

【Figure 12B】
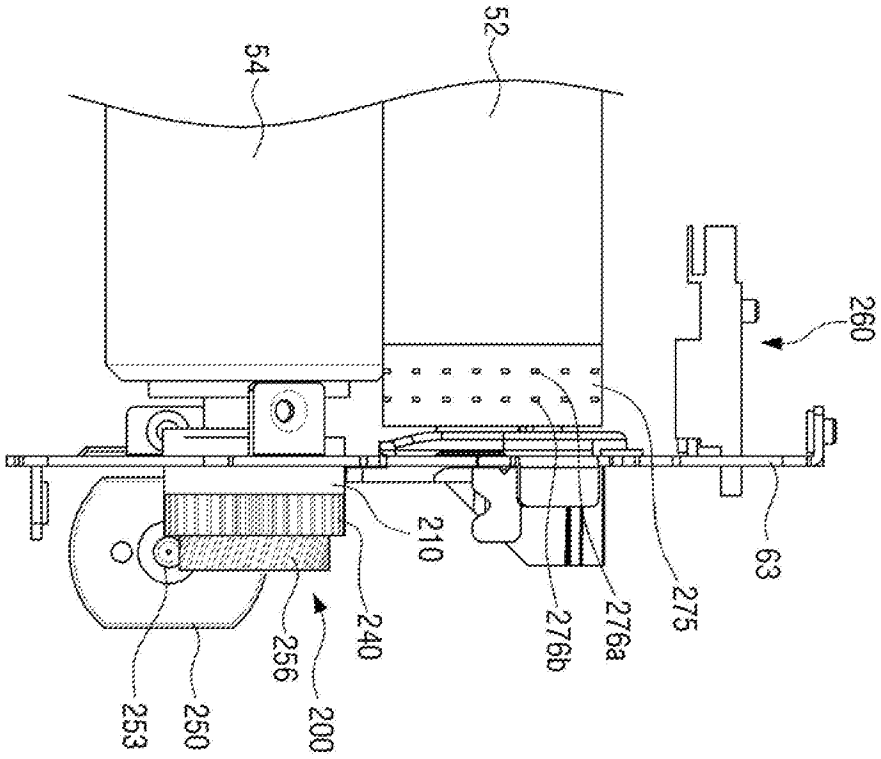

【Figure 13】
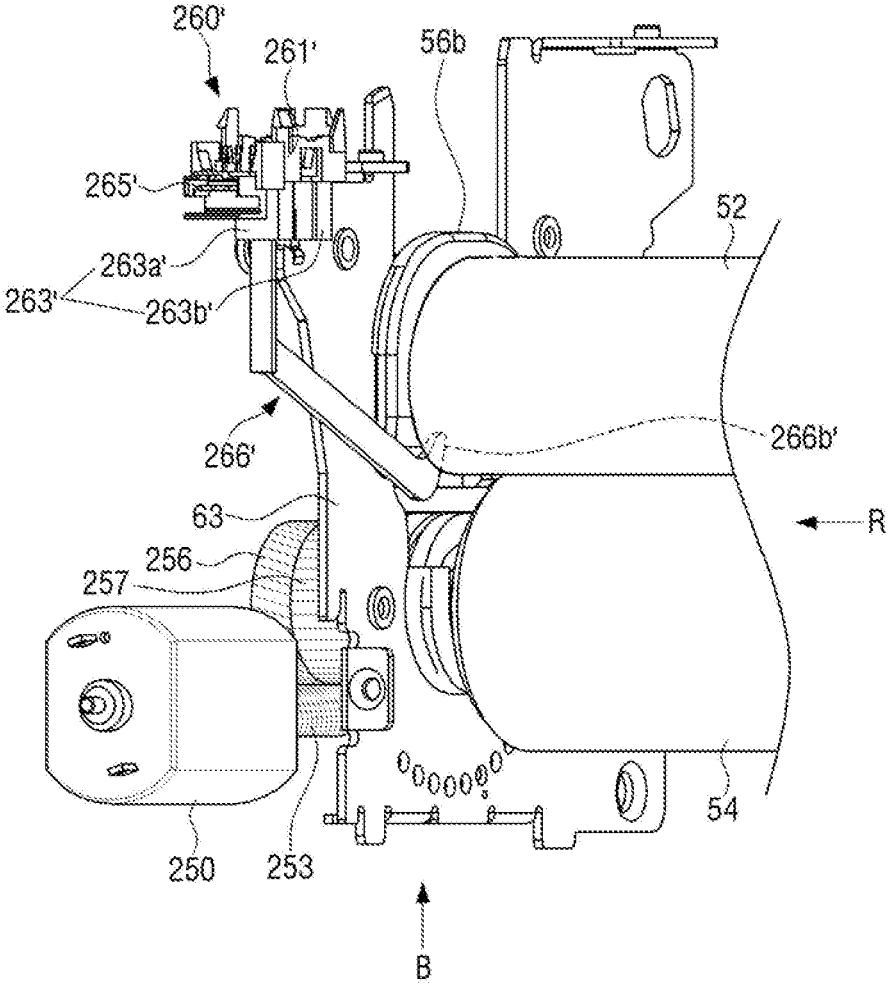

【Figure 14】
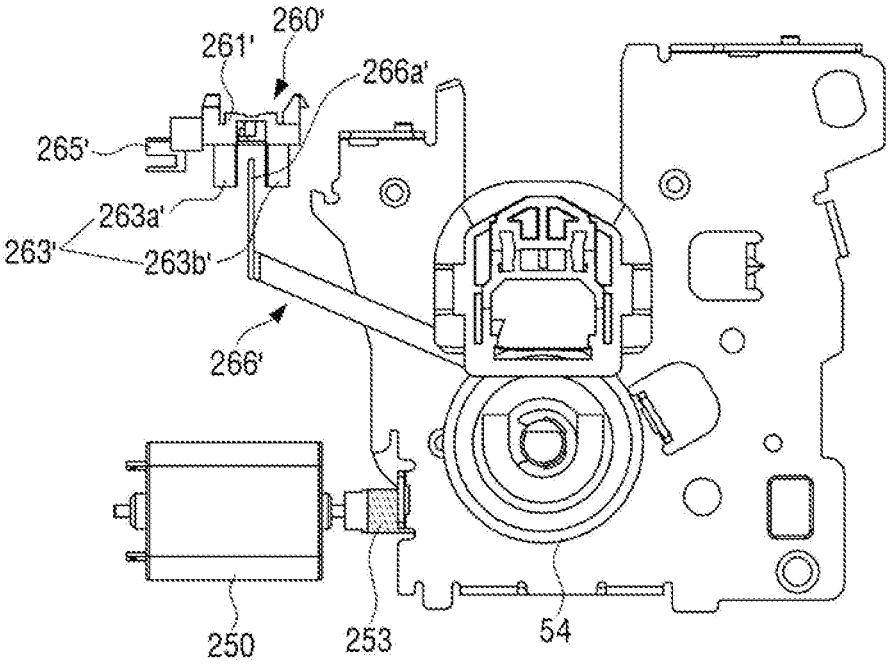

【Figure 15】
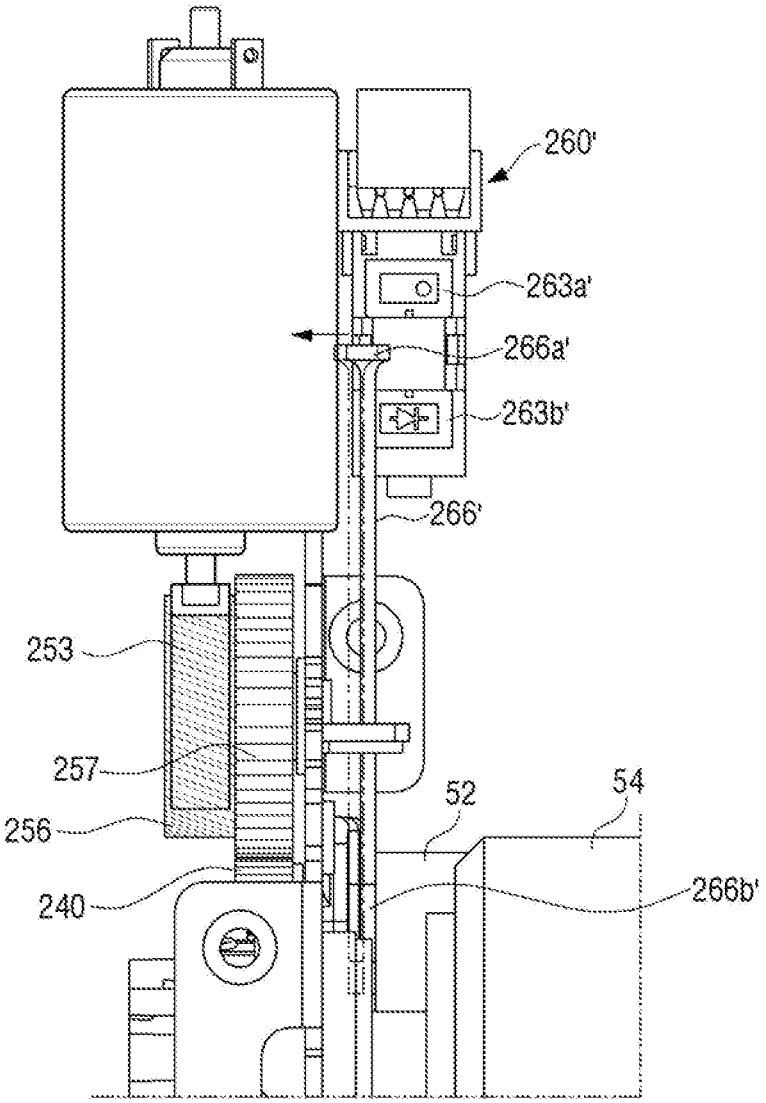

【Figure 16】
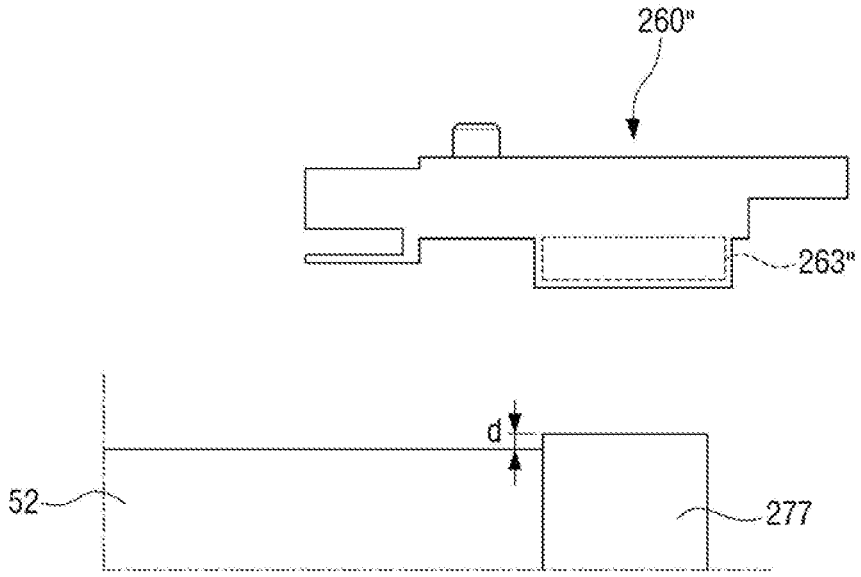

【Figure 17】
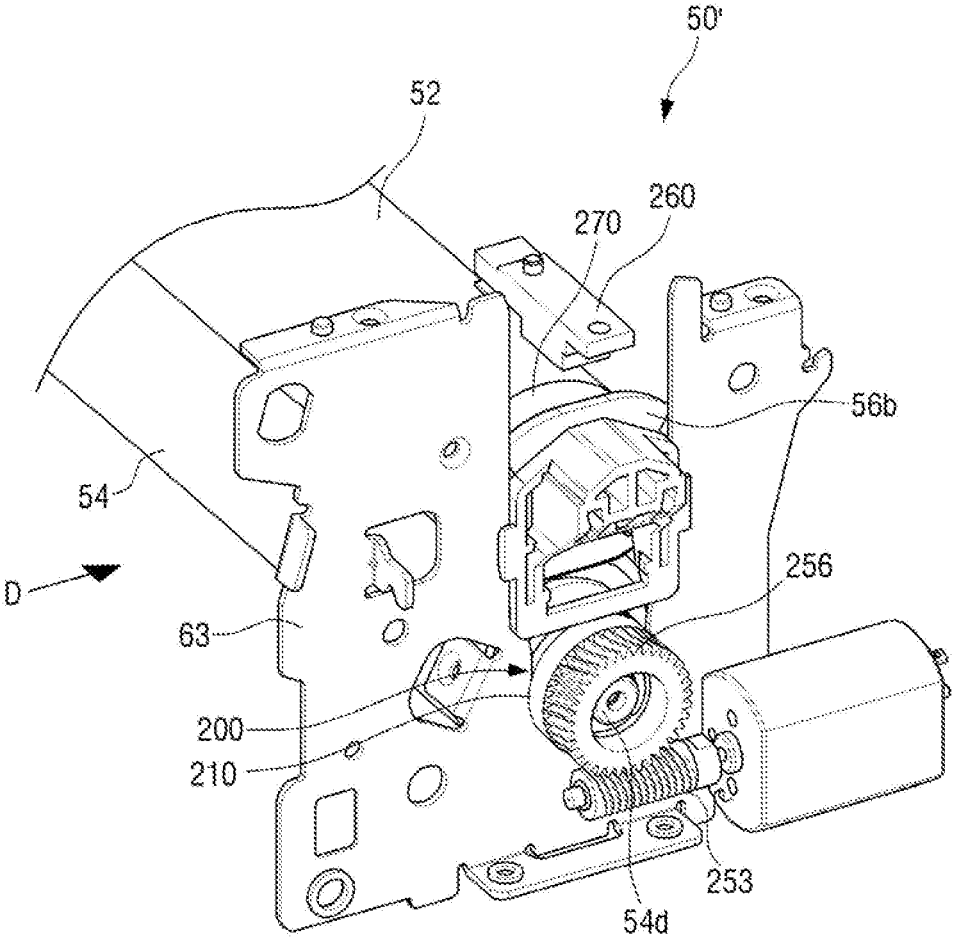

【Figure 18】
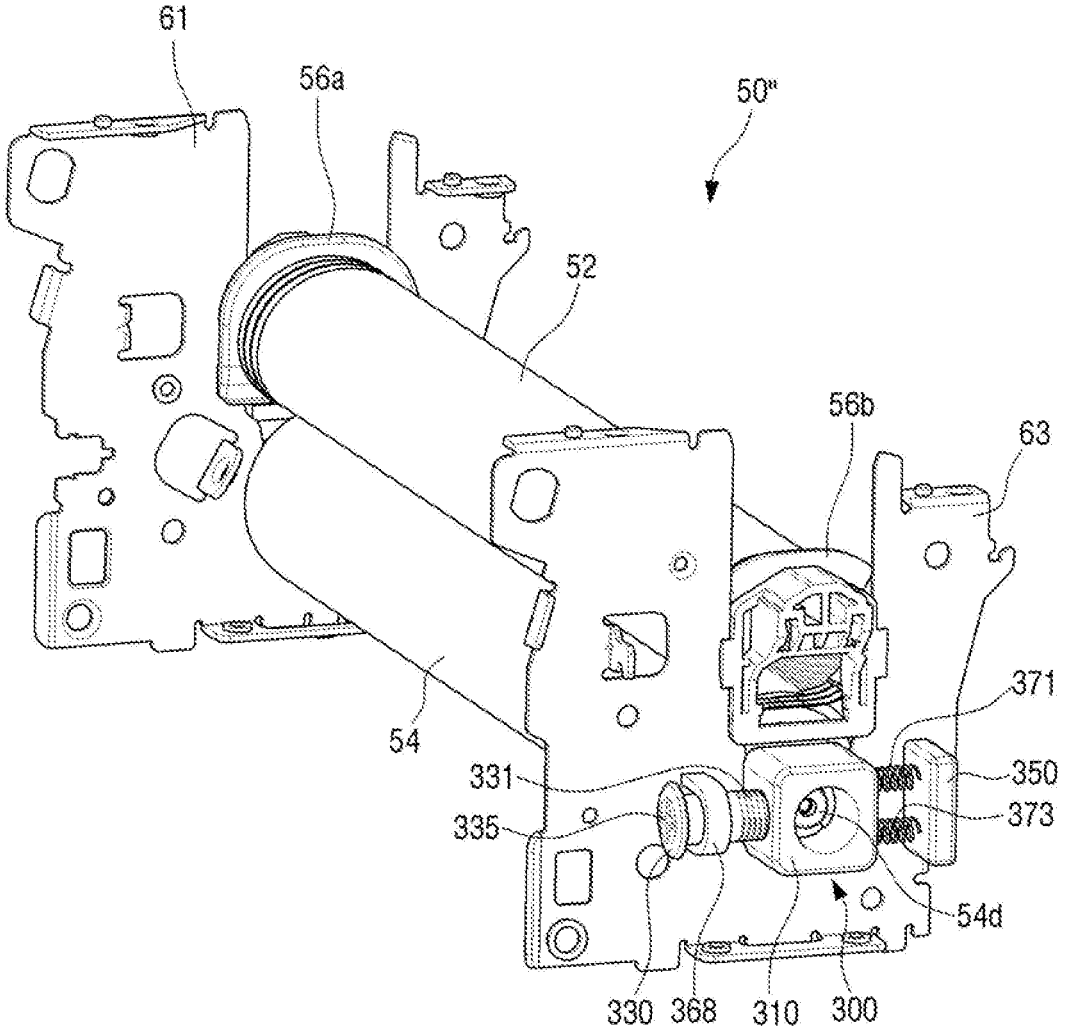

【Figure 19】
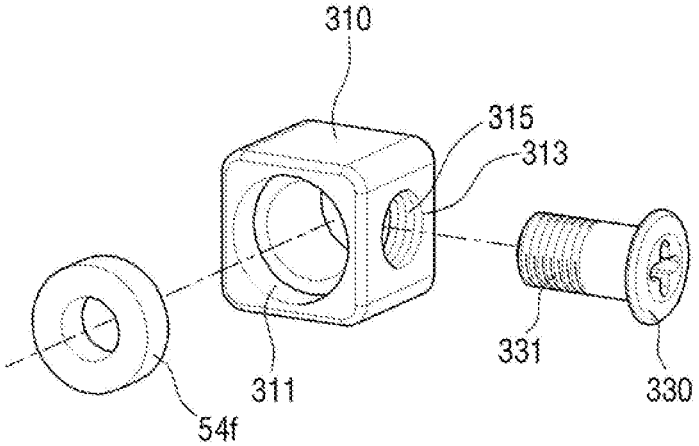
【Figure 20】
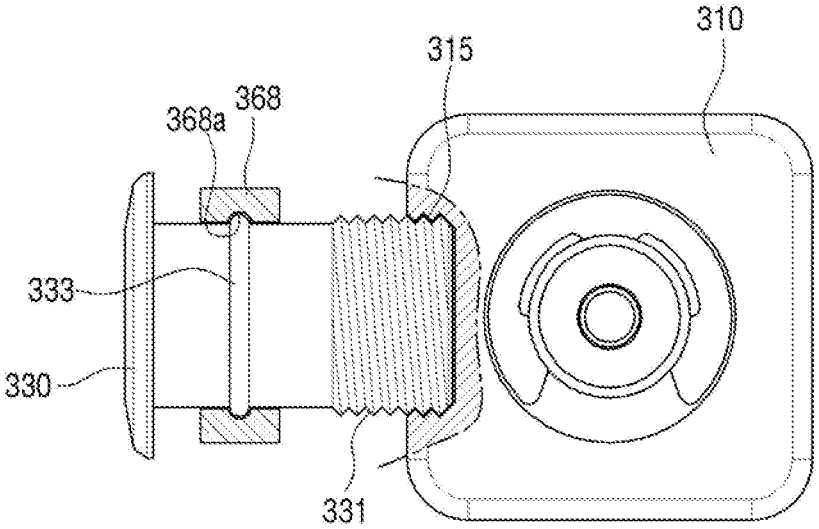

【Figure 21】
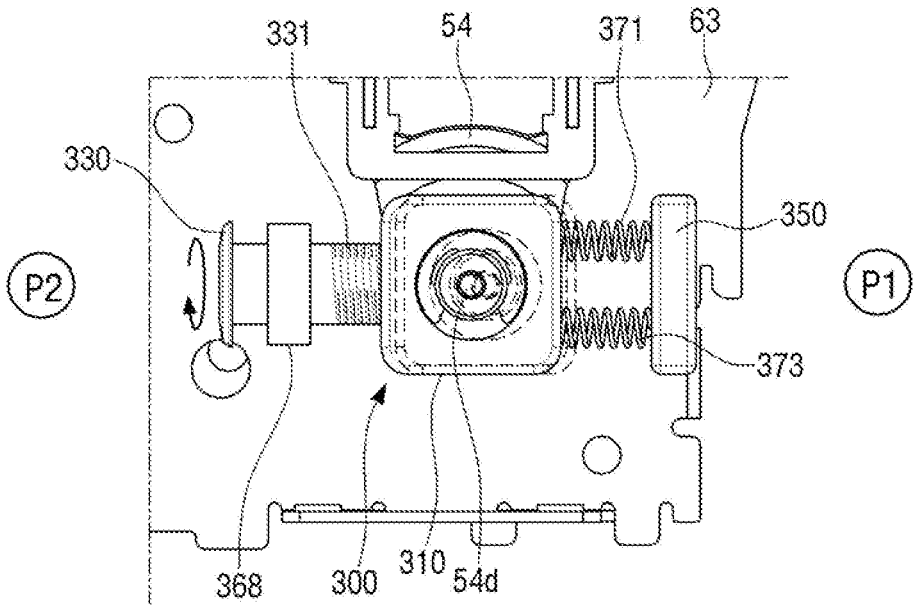
【Figure 22】
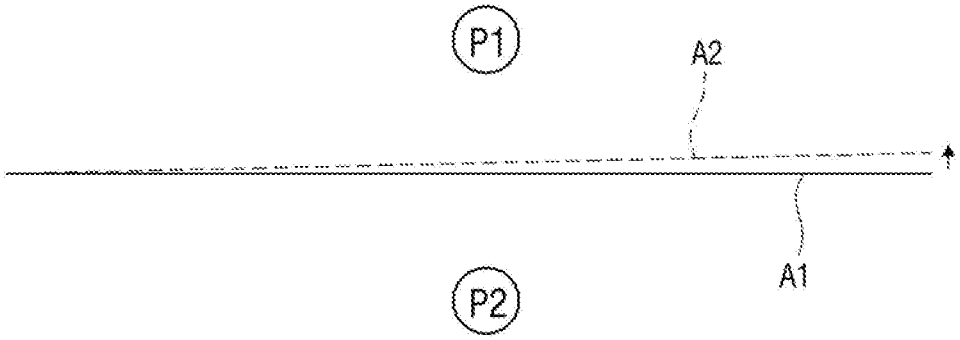

【Figure 23】
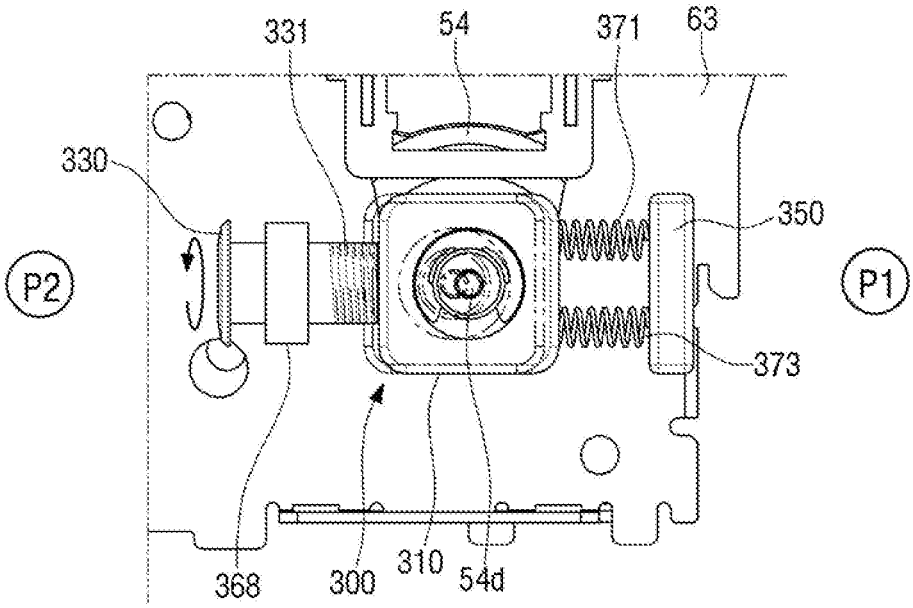
【Figure 24】
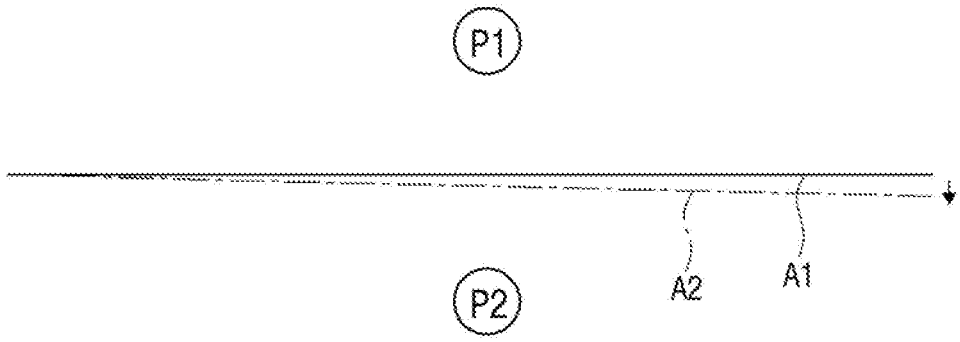

FIXING APPARATUS AND IMAGE FORMING APPARATUS HAVING THE SAME

CROSS-REFERENCE TO RELATED APPLICATIONS

This application is filed under 35 U.S.C. § 371 as a PCT national phase of PCT International Application No. PCT/KR2018/005910, filed on May 24, 2018, in the Korean Intellectual Property Office, which claims the priority benefit of Korean Patent Application No. 10-2017-0089134, filed on Jul. 13, 2017 in the Korean Intellectual Property Office, the contents of the PCT International Application and the Korean Patent Application are incorporated by reference herein in their entirety.

BACKGROUND ART

In general, image forming apparatuses may include a fixing apparatus configured to fix a toner image, which is carried on a recording medium (for example, paper), to the recording medium by heating and pressing the recording medium. The fixing apparatuses may form a fixing nip portion between a fixing belt and a pressing roller by pressing a pressing member disposed in an inner circumferential side of the fixing belt to the pressing roller disposed in an outer circumferential side of the fixing belt. The fixing apparatuses may heat the recording medium which passes through the fixing nip portion by heating the fixing belt through a heat source disposed in the inner side of the fixing belt.

DISCLOSURE

Description of Drawings

The above and/or other aspects of the disclosure will be more apparent by describing certain exemplary embodiments of the disclosure with reference to the accompanying drawings, in which:

FIG. 1 is a diagram illustrating a schematic configuration of an image forming apparatus according to an embodiment;

FIG. 2 is a perspective view illustrating a fixing apparatuses of FIG. 1;

FIG. 3A is a cross-sectional diagram illustrating an inside of a fixing apparatus including a heater for heating a portion of a fixing belt according to an embodiment;

FIG. 3B is a cross-sectional diagram illustrating an inside of a fixing apparatus including a halogen lamp for heating an entire fixing belt according to an embodiment;

FIG. 4 is a diagram illustrating one side of a fixing apparatus in which a meandering adjustment member of a fixing belt for varying a position of a rotation shaft of a pressing roller according to an embodiment;

FIG. 5 is an exploded perspective view illustrating a structure that the meandering adjustment member of FIG. 4 supports the rotation shaft of the pressing roller according to an embodiment;

FIG. 6 is a perspective view illustrating the meandering adjustment member illustrated in FIG. 5;

FIG. 7 is a perspective view illustrating an example that the rotation center of a meandering adjustment member is located in an eccentric position with the rotation center of a pressing member according to an embodiment;

FIG. 8 is a diagram illustrating an example that a meandering adjustment member rotates clockwise or counterclockwise according to an embodiment;

FIG. 9 is a diagram illustrating an example that a position of a central axis of a pressing roller moves according to clockwise or counterclockwise rotation of a meandering adjustment member according to an embodiment;

FIG. 10 is a perspective view illustrating a fixing apparatus including a meandering adjustment structure of a fixing belt according to another embodiment;

FIG. 11 is a diagram illustrating an example that meandering of the fixing belt is detected using a photosensor when viewed in an arrow D direction of FIG. 10 according to an embodiment;

FIG. 12A is a diagram illustrating an example that meandering of a fixing belt is detected using a photosensor, wherein a reflection body is coupled to one end of a fixing belt and a pair of solid line patterns are formed in the reflection body according to an embodiment;

FIG. 12B is a diagram illustrating an example that meandering of a fixing belt is detected using a photosensor, wherein a reflection body is coupled to one end of the fixing belt and two-row dotted-line patterns are formed in the reflection body according to an embodiment;

FIG. 13 is a diagram illustrating an example that meandering of a fixing belt is detected using a photosensor and an actuator according to an embodiment;

FIG. 14 is a diagram illustrating a fixing apparatuses when viewed in an arrow R direction of FIG. 13 according to an embodiment;

FIG. 15 is a diagram illustrating a fixing apparatuses when viewed in an arrow B direction of FIG. 13 according to an embodiment;

FIG. 16 is a diagram illustrating an example that meandering of a fixing belt is detected using a height sensor according to an embodiment;

FIG. 17 is a perspective view illustrating an example that a worm gear is directly coupled to a rotation part of a meandering adjustment member according to an embodiment;

FIG. 18 is a perspective view illustrating a fixing apparatus having a meandering adjustment structure of a fixing belt according to an another embodiment;

FIG. 19 is a perspective view illustrating a coupling relationship between partial components constituting the meandering adjustment structure of FIG. 18 according to an embodiment;

FIG. 20 is a diagram illustrating a structure that a control screw is coupled to a fixing part and rotated according to an embodiment;

FIG. 21 is a diagram illustrating an example that a rotation shaft of a pressing roller moves to a P1 direction through a bearing holder in rotation of a control screw to one direction according to an embodiment;

FIG. 22 is a diagram illustrating an example that a central axis of a pressing roller moves to a P1 direction through position movement of the rotation shaft of FIG. 21 according to an embodiment;

FIG. 23 is a diagram illustrating an example that a rotation shaft of a pressing roller moves to a P2 direction through a bearing holder in rotation of a control screw to a reverse direction according to an embodiment; and FIG. 24 is a diagram illustrating an example that a central axis of a pressing roller moves to a P2 direction through position movement of the rotation shaft of FIG. 23 according to an embodiment.

MODE FOR INVENTION

Reference will now be made in detail to the embodiments, examples of which are illustrated in the accompanying drawings, wherein like reference numerals refer to like elements throughout. The embodiments are described below to explain the disclosure by referring to the figures.

Hereinafter, embodiments of the disclosure will be described more fully with reference to the accompanying drawings, in which the embodiments of the disclosure are shown to understand a configuration and an effect of the disclosure. This disclosure may, however, be embodied and modified in many different forms and should not be construed as limited to the embodiments set forth herein. Rather, these embodiments are provided so that this closure will be thorough and complete, and will fully convey the scope of the disclosure to those skilled in the art. In the drawings, sizes of elements may be enlarged and a ratio between the elements may be exaggerated or reduced for clarity.

It will be understood that, although the terms first, second, etc. may be used herein in reference to elements of the disclosure regardless of an order and/or importance, such elements should not be construed as limited by these terms. The terms are used only to distinguish one element from other elements. For example, without departing from the spirit of the inventive concept, a first element may refer to a second element, and similarly, the second element may refer to the first element.

The terminology used herein is for the purpose of describing particular embodiments only and is not intended to be limiting of the inventive concept. As used herein, the singular forms "a," "an" and "the" are intended to include the plural forms as well, unless the context clearly indicates otherwise. It will be further understood that the terms "comprises" and/or "includes" when used in this specification, specify the presence of stated features, integers, steps, operations, elements, components, and/or groups thereof, but do not preclude the presence or addition of one or more other features, integers, steps, operations, elements, components, and/or groups thereof.

It will be further understood that the terms used herein should be interpreted as the meaning defined herein. Unless otherwise defined, all terms including technical and scientific terms used herein have the same meaning as commonly understood by one of ordinary skill in the art to which this inventive concept belongs.

Hereinafter, an image forming apparatus according to an embodiment will be described with reference to the accompanying drawings and then a fixing apparatus disposed inside the image forming apparatus and a meandering adjustment structure implemented in the fixing apparatus will be described.

A schematic configuration of an image forming apparatus according to an embodiment will be described with reference to FIG. 1.

An image forming apparatus 10 may be an apparatus which forms a color image using colors, for example, magenta (M), cyan (C), yellow (Y), black (K), and the like. The image forming apparatus 10 may include a conveying device 11 configured to convey paper P as a recoding medium, a developing device 20 configured to develop an electrostatic latent image, a transfer device 30 configured to secondarily transfer a toner image on the paper P, a photosensitive drum 40 which is a latent image support in which an image is formed in a circumferential surface, a fixing apparatus 50 configured to fix the toner image onto the paper P, and a discharging device 60 configured to discharge the paper P.

The conveying device 11 may convey the paper P as a recording medium in which an image is formed on a convey path R1. The paper P may be stacked and received in a cassette K and picked up and conveyed through a paper-feed roller 12. The conveying device 11 may allow the paper P to reach a transfer nip portion R2 through the convey path R1 in a timing that the toner image to be transferred on the paper P reaches the transfer nip portion R2.

Four developing devices 20 for four colors may be provided. The developing device 20 may include a developing roller 21 configured to carry the toner to a photosensitive drum 40. The developing device 20 may control a mixing ratio of the toner and a carrier to a desired ratio. For example, a developer may be adjusted to have an optimal charge amount by uniformly dispersing the toner through mixing and stirring the toner and carrier. The developer may be carried to a developing roller 21. The toner of the developer carried to the developing roller 21 may be moved to the elastic latent image formed on a circumferential surface of the photosensitive drum 40 in response to the developer being moved to a region facing the photosensitive drum 40 through rotation of the developing roller 21 and thus the elastic latent image may be developed.

The transfer device 30 may convey the toner image formed in the developing device 20 to a transfer nip portion R2 which secondarily transfers the toner image onto the paper P. The transfer device 30 may include a transfer belt 31 to which the toner image is primarily transferred from the photosensitive drum 40, first to fourth suspension rollers 34, 35, 36, and 37 which suspends the transfer belt 31, a primary transfer roller 32 which holds the transfer belt 31 with the photosensitive drum 40, and a secondary transfer roller 33 which holds the transfer belt 31 with the suspension roller 37.

The transfer belt 31 may be an endless belt which circularly moves through the first to fourth suspension rollers 34 to 37. The first to fourth suspension rollers 34 to 37 may be rollers which is rotatable to center axis directions thereof. The fourth suspension roller 37 may be a driving roller which is rotatably driven to the center axis direction and the first to third suspension rollers 34 to 36 may be driven rollers which are driven to rotate through the rotation driving of the suspension roller 37. The primary transfer roller 32 may be provided to press the photosensitive drum 40 from an inner circumferential side of the transfer belt 31. The secondary transfer roller 33 may be disposed in parallel with the suspension roller 37 with the transfer belt 31 intervened therebetween and may be provided to press the suspension roller 37 from an outer circumferential side of the transfer belt 31. Accordingly, the secondary transfer roller 33 may form the transfer nip portion R2 between the secondary transfer roller 33 and the transfer belt 31.

Four photosensitive drums 40 for four colors may be provided. The photosensitive drums 40 may be provided along a moving direction of the transfer belt 31. The developing device 20, a charge roller 41, an exposure unit 42, and a cleaning unit 43 may be provided on a circumference of the photosensitive drum 40.

The charge roller 41 may be a charge unit configured to uniformly charge the surface of the photosensitive drum 40 to a desired potential. The charge roller 41 may move according to the rotation of the photosensitive drum 40. The exposure unit 42 may exposure the surface of the photosensitive drum 40 charged through the charge roller 41 according to an image to be formed in the paper P. Accordingly, the potential in a portion of the surface of the photosensitive drum 40 which is exposed through the exposure unit 42 may be changed and thus the electrostatic latent image may be formed.

The four developing devices 20 may develop the electrostatic latent image formed in the photosensitive drum 40 through the toners supplied from toner tanks N provided to face the developing devices 20 and the toner image may be formed. The M, Y, C, and B toners may be charged in the toner tanks N. The cleaning unit 43 may collect the toner remaining on the photosensitive drum 40 after the toner image formed on the photosensitive drum 40 is primarily transferred to the transfer belt 31.

The fixing apparatus 50 may allow the paper P to pass through a fixing nip portion R3 for heating and pressing and attach and fuse the toner image, which is secondarily transferred to the paper P from the transfer belt 31, to the paper P.

The fixing apparatus 50 may include a fixing belt 52 configured to heat the paper P and a pressing roller 54 configured to press the fixing belt 52 and rotatably drive the fixing belt 52. The fixing belt 52 may be formed of a thin metal material and the pressing roller 54 may be formed in a cylindrical shape and include a heater source (for example, a heater configured to partially heat the fixing belt, a halogen lamp configured to entirely heat the fixing belt, or the like) in the inside thereof. The fixing nip portion R3 as a contact region may be provided between the fixing belt 52 and the pressing roller 54 and the fixing apparatus 50 may allow the paper P to pass through the fixing nip portion R3 and fuse and fix the toner image onto the paper P.

The discharging device 60 may include discharge rollers 62 and 64 configured to discharge the paper P on which the toner image is fixed through the fixing apparatus 50 to the outside of the image forming apparatus 10.

Next, a printing process through the image forming apparatus 10 will be described. A controller (not shown) of the image forming apparatus 10 may rotate the paper-feed roller 12 and pick up and convey the pieces of papers P stacked in the cassette K in response to an image signal of an image to be recorded to the image forming apparatus 10. The controller of the image forming apparatus 10 may uniformly charge the surface of the photosensitive drum 40 to a desired potential based on the received image signal through the charge roller 41 (charging process). The controller of the image forming apparatus 10 may form the electrostatic latent image by radiating laser light to the surface of the photosensitive drum 40 through the exposure unit 42 (exposure process).

Through the developing device 20, the electrostatic latent image may be developed and the toner image may be formed (developing process). The toner image formed as described above may be primarily transferred to the transfer belt 31 from the photosensitive drum 40 in a region in which the photosensitive drum 40 and the transfer belt 31 face each other (transfer process). In the transfer belt 31, the toner images formed on the four photosensitive drums 40 may be sequentially laminated and thus one laminated toner image may be formed. The laminated toner image may be secondarily transferred to the paper P conveyed from the conveying device 11 in the transfer nip portion R2 in which the suspension roller 37 and the secondary transfer roller 33 face each other.

The paper P to which the laminated toner image is secondarily transferred may be conveyed to the fixing apparatus 50. The fixing apparatus 50 may fuse and fix the laminated toner image to the paper P by heating and pressing the paper P between the fixing belt 52 and the pressing roller 54 while the paper P passes through the fixing nip portion R3 (fixing process). Then, the paper P may be discharged to the outside of the image forming apparatus 10 through the discharge rollers 62 and 64.

Hereinafter, the fixing apparatus 50 and a meandering adjustment structure implemented in the fixing apparatus 50 according to an embodiment will be described.

Referring to FIGS. 2 and 3A, the fixing apparatus 50 may include the fixing belt 52 having a fixed length, the pressing member 53*a* disposed in the inside of the fixing belt 52, a heat source 56 inserted into a bottom surface of the pressing member 53*a*, the pressing roller 54 disposed substantially in parallel with the fixing belt 52 and configured to form a nip by pressing the fixing belt 52 and rotate the fixing belt 52, and a temperature sensor 57 and a thermostat 58 configured to block power supply.

The fixing belt 52 may be a cylindrical endless belt and may be typically formed of a resin film or a metal sleeve. The fixing belt 52 may include a base layer and a release layer covered on one surface of the base layer in a pressing roller 54 side or both surfaces of the base layer. For example, an elastic layer may be disposed between the base layer and the release layer to improve image quality of a printed matter and thus a relatively wide and flat fixing nip portion may be formed.

The base layer of the fixing belt 52 may be formed of a heat-resistant resin such as polyimide, polyamide, and polyimide amide, a metal such as stainless use steel (SUS), nickel, and copper and may have a thickness in a range of 30 to 200 μm. For example, the base layer may have the thickness of 50 to 100 μm. The release layer covered on the surface of the base layer may be formed of a fluorine-based resin. The fluorine-based resin may include a copolymer of perfluoroalkoxy (PFA), polytetrafluoroethylene (PTFE), ethylene tetrafluoride, and ethylene hexafluoride, for example, fluorinated ethylene propylene (FEP) and may have a thickness of 10 to 30 μm. The fluorine-based resin may be mainly used as the material for the release layer and may have a thickness of 10 to 50 μm. The fluorine-based resin may include a copolymer of perfluoroalkoxy (PFA), polytetrafluoroethylene (PTFE), ethylene tetrafluoride, and ethylene hexafluoride, and the like. A tube formed of a fluorine-based resin may be used as the release layer and the release layer may be manufactured through a coating method using the fluorine-based resin. As an elastic layer, fluorine rubber, silicon rubber, and the like may be used. The elastic layer may include an insulating elastic layer and the insulating elastic layer may contain one material or two or more materials of various rubber materials and various elastic materials. The rubber materials may include fluorine rubber, silicone rubber, natural rubber, isoprene rubber, butadiene rubber, nitrile rubber, chloroprene rubber, butyl rubber, acrylic rubber, hydrin rubber, urethane rubber, and the like. The elastic materials may include thermoplastic elastomers and the thermoplastic elastomers may include styrene-based, polyolefin-based, polyvinyl chloride-based, polyurethane-based, polyester-based, polyamide-based, polybutadiene-based, transpoly isoprene-based, and chlorinated polyethylene-based elastomers.

Both ends of the fixing belt 52 may be guided by first and second bushes 56*a* and 56*b* detachably coupled to first and second support frames 61 and 63 in rotation.

The pressing member 53*a* may be a member which is disposed along a length direction of an inner circumferential surface of the fixing belt 52 and forms an ideal fixing nip portion between the fixing belt 52 and the pressing roller 54 by pressing the pressing roller 54 through the fixing belt 52. As the pressing member 53*a*, a material having a good heat insulating property and having a porous structure may be used. A metal bracket 53*b* may be disposed in an upper side of the pressing member 53*a* and the heat source 56 may be inserted into the bottom surface of the pressing member 53*a*. The pressing member 53*a* and the metal bracket 53*b* may be formed to substantially have a length corresponding to a length of the fixing belt. The metal bracket 53*b* may be pressed through the first and second bushes 56*a* and 56*b* and may press the pressing member 53*a* to the pressing roller 54 side. Both ends of the metal bracket 53*b* may be supported through the first and second bushes 56*a* and 56*b*.

A driving shaft 54*a* which receives power from a power source disposed in the image forming apparatus 10 may be disposed in one side of the pressing member 54 and a rotation shaft 54*d* may be disposed in the other side (or non-driving shaft) of the pressing roller 54. The driving shaft 54*a* and the rotation shaft 54*d* may be indirectly rotatably supported to the first and second support frames 61 and 63 disposed in both sides of the pressing roller 54. For example, a first bearing retainer 54*b* may be coupled to the first support frame 61 and a first bearing 54*c* configured to support the driving shaft 54*a* may be inserted into the first support frame 61. A meandering adjustment member 100 may be rotatably coupled to the second support frame 63 and a second bearing (see 54*f* of FIG. 5) configured to support the rotation shaft 54*d* may be inserted into the second support frame 63. The first and second bearings 54*c* and 54*f* may include a ring bearing or a radial bearing.

The heat source 56 may partially heat the fixing belt 52 to be confined to the fixing nip portion of the fixing belt 52.

The sensor 57 may detect a temperature of the heat source 56. A controller (not shown) of the image forming apparatus 10 may increase the temperature of the heat source 56 to a fixable range by supplying power to the heat source 56 in response to the temperature of the heat source 56 being reduced to the fixable range or less.

The thermostat 58 may be disposed in the pressing member 53*a* and block power supply to the heat source 56 according to a state of the fixing belt 52. The thermostat 58 may have a bimetal and block the power supply to the heat source 56 in response to the temperature of the bimetal is equal to or larger than a threshold value.

The fixing apparatus 50 according to an embodiment may be configured to partially heat the fixing belt 52 as illustrated in FIG. 3A, but this is not limited thereto and the fixing belt 52 may be entirely heated using a halogen lamp 56' as a heat source as illustrated in FIG. 3B. The halogen lamp 56' may be disposed in a metal bracket 53*b*' disposed in an upper side of the pressing member 53*a*'. For example, a temperature sensor 57' and a thermostat 58' may be disposed in an outer circumferential surface of the fixing belt 52.

Hereinafter, a meandering adjustment structure configured to prevent meandering of the fixing belt 52 according to an embodiment will be described with reference to FIGS. 4 to 7.

The meandering adjustment structure according to an embodiment may include the meandering adjustment member 100. The meandering adjustment member 100 may vary the position of the rotation shaft 54*d* of the pressing roller 54 to a direction perpendicular to the center axis of the pressing roller. For example, the meandering adjustment member 100 may move one end of the center axis (see A2 of FIG. 2) of the pressing roller 54 toward a P1 direction (see FIG. 8) or to a P2 direction (see FIG. 8) which is a reverse direction of the P1 direction. In this example, the center axis A2 of the pressing roller 54 may be set to any one of a position in which the center axis A2 is in parallel with the center axis (see A1 of FIG. 2) of the fixing belt 52, a position in which the center axis A2 is inclined to the P1 direction, and a position in which the center axis A2 is inclined to the P2 direction.

Referring to FIGS. 4 and 5, the meandering adjustment member 100 may support the rotation shaft 54*d* of the pressing roller 54 through the second bearing 54*f*. The meandering adjustment member 110 may include a rotation part 110 substantially having a circular shape and a lever 130 formed to extend to a fixed length from a portion of the rotation part 110.

Referring to FIG. 5, a receiving groove 111 into which the second bearing 54*f* is inserted may be formed in one side of the rotation part 110 and a guide groove 113 may be formed along an outer circumferential surface of the rotation part 110. The guide groove 113 may be formed so that the rotation part 110 is rotatably disposed with respect to the second support frame 63. For example, a concave portion 63*a* of the second support frame 63 may be inserted into the guide groove 113. The concave portion 63*a* may be formed to have the same curvature as that of the guide groove 113 and thus the rotation part 110 may rotate a clockwise direction CW or a counterclockwise direction (CCW) (see FIG. 8). A stop ring 54*g* may be inserted into a fixing groove 54*e* of the rotation shaft 54*d* so that the second bearing 54*f* is not deviated from the rotation shaft 54*d*.

Referring to FIG. 4, the lever 130 may be configured to rotate the rotation part 110 and may be formed to extend from a portion of an outer circumferential surface of the rotation part 110. The length of the lever 130 may be formed in consideration of positions of a plurality of locking holes 65*a*, 65*b*, and 65*c* formed in the second support frame 63. For example, the lever 130 may be formed to have a length so that a locking protrusion (see 131 of FIG. 6) formed in one lateral surface (for example, a surface facing the second support frame 63) of the lever 130 is selectively snap-coupled to any one of the plurality of locking holes 65*a*, 65*b*, and 65*c*. The plurality of locking holes 65*a*, 65*b*, and 65*c* may be arranged at fixed intervals along an arc concentric with the rotation center (see C2 of FIG. 7) of the meandering adjustment member 100.

In response to the locking protrusion 131 being snap-coupled to any one 65*a* (hereinafter, referred to as 'first locking hole 65*a*') among the plurality of locking holes, the center axis A2 of the pressing roller 54 may be disposed in parallel with the center axis A1 of the fixing belt 54 when the fixing apparatus 50 is viewed on a plane (in an arrow T direction illustrated in FIG. 2).

In order for the user to easily recognize the first locking hole 65*a*, a certain mark (see 67 of FIG. 5) may be formed in a portion of one surface of the second support frame 63 close to the first locking hole 65*a*.

A portion of the plurality of locking holes other than the first locking hole 65*a* may be a plurality of second locking holes 65*b* arranged clockwise about the first locking hole 65*a* and the remaining portion of the plurality of locking holes may be a plurality of third locking holes 65*c* arranged counterclockwise about the first locking hole 65*a*.

Referring to FIG. 7, the rotation center C2 of the meandering adjustment member 100 may be arranged to be spaced at a fixed interval g from the rotation center C1 of the pressing roller 54. As the rotation center C2 of the meandering adjustment member 100 is eccentrically arranged with the rotation center C1 of the pressing roller 54, one end (or the rotation shaft 54*d*) of the center axis A2 of the pressing roller 54 may be moved to the P1 direction or the P2 direction (see FIG. 9) in response to the meandering adjustment member 100 being rotated clockwise or counterclockwise.

An operation of the meandering adjustment member 100 will be described with reference to FIGS. 8 and 9.

For example, a distance between the center axis A2 of the pressing roller 54 and the center axis A1 of the fixing belt 52 in the P1 direction may be increasingly increased so that the locking protrusion 131 is snap-coupled to the second locking hole located far away from the second locking hole nearest to the first locking hole 65*a*. In this example, the meandering adjustment member 100 may rotate clockwise (CW) so that the locking protrusion 131 may be snap-coupled to any one of the plurality of second locking holes.

In another example, a distance between the center axis A2 of the pressing roller 54 and the center axis A1 of the fixing belt 52 in the P2 direction may be increasingly increased so that the locking protrusion 131 is snap-coupled to the third locking hole located far away from the third locking hole nearest to the first locking hole 65*a*. In this example, the meandering adjustment member 100 may rotate counterclockwise (CCW) so that the locking protrusion 131 may be snap-coupled to any one of the plurality of third locking holes.

For example, to prevent the meandering of the fixing belt 52, the user may determine the meandering direction of the fixing belt 52 and may rotate the meandering adjustment member 100 counterclockwise in response to the fixing belt 52 being moved to a non-driving side and rotate the meandering adjustment member 100 clockwise in response to the fixing belt 52 being moved to a driving side.

In this example, the center axis A2 (or the rotation shaft 54*d*) of the pressing roller 54 may move to the P1 direction in response to the meandering adjustment member 100 being rotated counterclockwise and the center axis A2 (or the rotation shaft 54*d*) of the pressing roller 54 may move to the P2 direction in response to the meandering adjustment member 100 being rotated clockwise.

In another example, the user may stop the rotation of the rotation part 110 in response to the fixing belt 52 being normally running without meandering during the meandering adjustment. In this example, the locking protrusion 131 may be snap-coupled to any one of the plurality of locking holes 65*a*, 65*b*, and 65*c* to fix the rotation part 110 to a fixed angle.

For example, the meandering adjustment of the fixing belt 52 may be first performed in a state that the locking protrusion 131 is snap-coupled to the first locking hole 65*a* and the center axis A1 of the fixing belt 52 is located in parallel with the center axis A2 of the pressing roller 54. However, this is not limited thereto and the meandering adjustment of the fixing belt 52 may be performed by rotating the meandering adjustment member 100 clockwise or counterclockwise in a state that the rotation part 110 is set to a fixed angle currently.

The meandering adjustment which is performed through the meandering adjustment member 100 according to an embodiment may be performed through a direct manual operation of the meandering adjustment member 100 by the user. A meandering adjustment member 200 of a fixing apparatus according to another embodiment to be described below may detect the meandering of the fixing belt 52 through a sensor unit 260 and may be rotated clockwise or counterclockwise through a motor 250 driven according to a detection signal of the sensor unit 260. The meandering adjustment member 200 of the fixing apparatus according to another embodiment may vary a position of the center axis A2 of the pressing roller 54 through an automatic method.

Hereinafter, a fixing apparatus including a meandering adjustment structure of a fixing belt according to another embodiment will be described with reference to FIGS. 10 and 11. The same elements of a fixing apparatus 50' according to another embodiment as those of the fixing apparatus 50 may be denoted by the same reference numerals and detailed description thereof will be omitted.

Referring to FIG. 10, the meandering adjustment structure of a fixing belt according to another embodiment may include the meandering adjustment member 200, the motor 250, power transmission members 253, 256, and 257, and the sensor unit 260.

The meandering adjustment member 200 may include a rotation part 210 into which the second bearing 54*f* configured to support the rotation shaft 54*d* of the pressing roller 54 is inserted and a lever 230 extending from a portion of an outer circumferential surface of the rotation part 210. For example, the rotation center of the meandering adjustment member 200 may be eccentrically arranged with the rotation center of the pressing roller 54. The meandering adjustment member 200 according to another embodiment may have the same configuration as that of the meandering adjustment member 100 according to an embodiment.

The meandering adjustment member 200 may include a gear 240 in one surface of the rotation part 210 to receive the rotation force from the motor 250. For example, the gear 240 may be separately manufactured from the rotation part 210 and may be fixed to the rotation part 210. In another example, the gear 240 may be integrally manufactured with the rotation part 210. The meandering adjustment member 200 may be rotated clockwise or counterclockwise through the motor 250.

The motor 250 may include a step motor or a servo motor which may be rotated in a forward/reverse direction. A worm 253 may be axially coupled to the rotation shaft 251 of the motor 250 and a worm gear 256 may be engaged with the worm 253.

For example, a driven gear 257 coaxially arranged with the worm gear 256 may be coupled to a surface of the worm gear 256 which faces the second support frame 63. The worm gear 256 and the driven gear 257 may be formed as a double gear so that the driven gear 257 may be simultaneously rotated with the worm gear 256 in the same rotation direction as that of the worm gear 256. The worm gear 256 and the driven gear 257 may be rotatably coupled to a support shaft 258 extending from one surface of the second support frame 63. In another example, the worm gear 256 may be rotatably supported to a portion (not shown) of a structure formed in the inner side of the image forming apparatus 10.

The driven gear 257 may be configured of the same type of gear as the gear 240 of the meandering adjustment member 200 so that the driven gear 257 is engaged with the gear 240 of the meandering adjustment member 200. For example, both the gear 240 of the meandering adjustment member 200 and the driven gear 257 may include a spur gear or a helical gear.

It has been illustrated in FIG. 10 that the gear ratio between the gear 240 and the driven gear 257 is approximately 1:1, but this is not limited thereto and the gear ratio between the gear 240 and the driven gear 257 may have a suitable ratio according to the specification of the motor or a desired rotation speed of the motor.

Referring to FIG. 11, the sensor unit 260 may be disposed in a position upwardly spaced at a certain distance from a top surface of the fixing belt 52. For example, the sensor unit 260 may be fixed to an extension part (not shown) extending from one surface of the second support frame 63.

The sensor unit 260 may include a housing 261 fixed to the extension part of the second support frame 63, a photosensor 263 disposed in the inner side of the housing 261, and a terminal 265 which a signal line and a power line are in contact therewith in one side of the housing 261.

The photosensor 263 may include a general photosensor having a light-emitting unit (for example, light-emitting diode (LED)) and a light-receiving unit (for example, a photodiode).

An identification unit 270 configured to detect the meandering of the fixing belt 52 through the photosensor 263 may be formed in one end portion of the fixing belt 52. The identification unit 270 may have a different reflectance from the fixing belt 52 so that a difference between the amount of light detected through the light-receiving unit of the photosensor 263 and a preset amount of light may be caused in the meandering of the fixing belt 52. The term "different reflectance" may refer to the meaning that the reflectance of the identification unit 270 is larger than that of the surface (for example, a surface of the paper-passing region) of the fixing belt 52.

For example, the identification unit 270 may be formed of a thin coating layer which covers one end portion of the fixing belt 52. In another example, the identification unit 270 may be formed to have a different reflectance from the surface of the fixing belt 52 by peeling off a surface of the one end portion of the fixing belt 52.

The signal detected through the sensor unit 260 may be transmitted to a controller (not shown) provided in the image forming apparatus 10 in response to the fixing belt 52 being moved to the non-driving side in running. The controller may drive the motor 250 in the forward direction and rotate the meandering adjustment member 200 counterclockwise direction. Accordingly, the center axis A2 (or the rotation shaft 54*d*) of the pressing roller 54 may move to the P1 direction (see FIG. 9) and the fixing belt 52 may move to a driving side (a side in which the driving shaft 54*a* of the pressing roller is present).

The controller may rotate the meandering adjustment member 200 clockwise by driving the motor 250 in a reverse direction in response to the movement of the fixing belt 52 being determined to be absent through the signal detected through the sensor unit 260 for a fixed time. For example, the center axis A2 (or the rotation shaft 54*d*) of the pressing roller 54 may move to the P2 direction (see FIG. 9) and the fixing belt 52 may move to the driving side.

The meandering of the fixing belt 52 may be adjusted through the meandering adjustment structure according to another embodiment through the above-described method.

It has been described in the embodiment that the sensor unit 260 is disposed only in the non-driving side of the fixing belt, but this is not limited thereto and the sensor unit 260 may be disposed in both-side ends of the fixing belt 52, respectively.

A certain pattern may be formed in the identification unit to improve the detection accuracy for the meandering of the fixing belt 52.

For example, referring to FIG. 12A, the pattern configured of a pair of solid lines 274*a* and 274*b* spaced at a fixed interval may be formed in an identification unit 273. The pair of solid lines 274*a* and 274*b* may be formed along a circumferential direction of the identification unit 273 and may be formed with a color (for example, black) having a reflectance considerably smaller than that of the identification unit 273.

Referring to FIG. 12B, the pattern configured of a pair of dotted lines 276*a* and 276*b* spaced at a fixed interval may be formed in an identification unit 275. The pair of dotted lines 276*a* and 276*b* may be formed along a circumferential direction of the identification unit 275 and may be formed with a color (for example, black) having a reflectance considerably smaller than that of the identification unit 275.

In another example, the pattern formed on the identification unit may be configured of three solid lines or three dotted lines. In this example, widths of the lines for the pattern may be different from each other and the lengths of the dots for the pattern may be different from each other.

It has been described in FIGS. 12A and 12B that the patterns on the identification units 273 and 275 are formed of two solid lines or two dotted lines, but this is not limited thereto. For example, the pattern may be formed in a unified form in the identification unit. In this example, the identification units may be formed in both end portions of the fixing belt 52, respectively. The patterns having different forms from each other may be formed in the identification units, respectively and thus the sensor units configured to detect the identification units may be disposed in upper sides of both end portions of the fixing belt, respectively.

The sensor unit 260 may include a reflective photosensor. However, this is not limited thereto and the sensor unit may detect the meandering of the fixing belt using the photosensor and an actuator detected through the photosensor.

Hereinafter, an example that detects the meandering of a fixing belt using a photosensor (hereinafter, referred to as 'transmissive photosensor' to distinguish the photosensor with a reflective photosensor) and an actuator will be described with reference to FIGS. 13 to 15.

Referring to FIGS. 13 and 14, a sensor unit 260' may include a housing 261', a transmissive photosensor 263' disposed in a lower side of the housing 261', a terminal 265' disposed in one side of the housing 261', and an actuator 266' detected through the transmissive sensor 263'.

The sensor unit 260' may be disposed to be spaced from the fixing belt 52 near the fixing belt 52. The transmissive sensor 263' may include a light-emitting unit 263*a*' and a light-receiving unit 263*b*' disposed to be spaced at a fixed interval.

One end 266*a*' of the actuator 266' may be disposed between the light-emitting unit 263*a*' and the light-receiving unit 263*b*' and the other end 266*b*' of the actuator 266' may be disposed between an edge of the fixing belt 52 and the second bush 56*b*.

Referring to FIG. 15, in response to the fixing belt 52 being moved to the non-driving side according to the meandering, the actuator 266' may be guided through a guide part (not shown) formed from the second support frame 63 or may be guided to a portion of an inner side of the image forming apparatus 10 so that the actuator 266' may be pushed through an edge of the fixing belt 52 and the other end 266*b*' of the actuator 266' may linearly move to a second bush 56*b* side. For example, in response to the fixing belt 52 being normally running through the meandering adjustment, the pressing force applied to the actuator 266' through the edge of the fixing belt 52 may be removed. In this example, the actuator 266' may move to an edge side of the fixing belt 52 through a certain elastic member (not shown) and move the initial position. The elastic member may be manufactured in consideration of a length and elastic force thereof so that the actuator 266' may be moved only to the initial position.

In response to the other end 266*b*' of the actuator 266' being pushed through the edge of the fixing belt 52 according to the meandering of the fixing belt 52 and then moved to the second bush 56*b* side, the light-receiving unit 263*b*' may receive the light radiated from the light-emitting unit 263*a*'. The sensor unit 260' may transmit the detection signal to the controller. The controller may determine the detection signal of the sensor unit 260' and rotate the meandering adjustment member 200 counterclockwise by driving the motor 250 to one direction according to a determination result. Accordingly, the center axis A2 (or the rotation shaft 54*d*) of the pressing roller 54 may move to the P1 direction (see FIG. 9).

In response to the fixing belt 52 being moved to the driving side through the meandering adjustment, the pressure applied to the other end of the actuator 266' through the fixing belt 52 may be released and the actuator 266' may move to an initial position direction through an elastic member. Accordingly, the one end 266*a*' of the actuator 266' may be located between the light-emitting unit 263*a*' and the light-receiving unit 263*b*' and the light-receiving unit 263*b*' may not receive the light radiated from the light-emitting unit 263*a'*.

The sensor unit 260' may transmit the detection signal to the controller and the controller may stop the driving of the motor 250 by determining the detection signal.

For example, the sensor units 260' may be disposed in both sides of the fixing belt 52, respectively. In this example, two actuators 266' may be provided to correspond to the sensor units 260'.

The sensor units 260 and 260' may detect the meandering of the fixing belt 52 through the photosensors 263 and 263', but this is not limited thereto and the sensor unit 260" may detect the meandering of the fixing belt 52 through a height sensor 263" as illustrated in FIG. 16. For example, an identification unit 277 may be formed to have a height difference d from the fixing belt 52. In this example, the identification unit 277 may be formed so that a surface of the identification unit 277 may be higher than that of the fixing belt 52. In another example, the identification unit 277 may be formed so that the surface of the identification unit 277 may be lower than that of the fixing belt 52.

The sensor unit 260" may be disposed only in the non-driving side of the fixing part, but this is not limited thereto. The sensor units 260" may be located in upper sides of both end portions of the fixing belt 52, respectively and the identification units 277 may be formed in both end portions of the fixing belt 52, respectively.

Accordingly, while the fixing belt 52 is running, the controller may drive the motor 250 in the forward or reverse direction by determining the meandering of the fixing belt 52 through the height detected through the sensor unit 260" and may move the center axis A2 (or the rotation shaft 54*d*) of the pressing roller 54 to the P1 direction or the P2 direction. The controller may stop the driving of the motor 250 in response to the detected height received from the sensor unit 260" being determined within a preset permissible range.

The rotation center C2 of the meandering adjustment members 100 and 200 may be eccentrically arranged with the rotation center C1 of the pressing roller 54 and the meandering of the fixing belt 52 may be prevented by adjusting the position of the center axis A2 (or the rotation shaft 54*d*) of the pressing roller through the clockwise/counterclockwise rotation of the meandering adjustment members 100 and 200.

Such a structure that varies the position of the center axis A2 (or the rotation shaft 54*d*) of the pressing roller 54 may move the center axis A2 (or the rotation shaft 54*d*) of the pressing roller 54 to a certain position by rotating a control screw 330 to the forward or reverse direction as illustrated in FIG. 18.

The gear 240 of the meandering adjustment member 200 and the double gear (worm gear 256 and driven gear 257) may be used to transmit the rotation force of the motor 250 to the meandering member 200 in the embodiment, but this is not limited thereto and the gear 240 and the driven gear 257 may be omitted in the fixing apparatus 50' according to another embodiment. For example, the worm gear 256 other than the gear 240 may be directly coupled to one surface of the rotation part 210 of the meandering adjustment member 200 as illustrated in FIG. 17. In this example, the worm gear 256 may directly transmit the rotation force applied from the worm 253 to the rotation part 210 of the meandering adjustment member 200.

Hereinafter, a fixing apparatus having a meandering adjustment structure of a fixing belt according to another embodiment will be described with reference to FIGS. 18 to 20. The same elements of a fixing apparatus 50" according to another embodiment as those of the fixing apparatus 50 may be denoted by the same reference numerals and detailed description thereof will be omitted.

Referring to FIGS. 18 and 19, the meandering adjustment structure of a fixing belt according to another embodiment may include the meandering adjustment member 300. The meandering adjustment member 300 may include a bearing holder 310 configured to support the second bearing 54*f*, the control screw 330 configured to move the bearing holder 310 to the P1 direction or the P2 direction, and elastic members 371 and 373 configured to elastically support the bearing holder 310 to a control screw 330 side.

A receiving groove 311 into which the second bearing 54*f* is inserted may be formed in a lateral surface of the bearing holder 310 which faces the second support frame 63. Accordingly, the bearing holder 310 may indirectly support the rotation shaft 54*d* of the pressing roller 54 through the second bearing 54*f*.

A coupling hole 313 into which one end portion of the control screw 330 is inserted may be formed in a lateral surface of the bearing holder 310 which is disposed substantially perpendicular to the lateral surface in which the receiving groove 311 is formed. A thread part 315 may be formed in an inner circumferential surface of the coupling hole 313.

The control screw 330 may be rotatably coupled to a fixing part 368 formed in one lateral surface of the second support frame 63. As illustrated in FIG. 20, a circular protrusion 333 may be formed along an outer circumference of the control screw 330 and a guide groove 368*a* into which the circular protrusion 333 is inserted may be formed in the inner side of the fixing part 368 and thus a rotation operation of the control screw 330 may be performed. Accordingly, the control screw 330 may not move to the forward/reverse direction along an axis direction of the control screw 330 and may rotate in place in the forward or reverse rotation.

For example, a thread part 331 may be formed in one end portion of the control screw 330 so that the control screw 330 may be screw-coupled to the coupling hole 313 of the bearing holder 310 and a cross groove 335 configured to allow the control screw 330 to be rotated using a certain tool (for example, a screw driver) may be formed in the other end portion of the control screw 330. In another example, a tight line groove other than the cross groove 335 may be formed in the control screw 330.

The elastic members 371 and 373 may include a pair of coil springs, but this is not limited thereto and the elastic members 371 and 373 may include a single coil spring. In response to the single coil spring being used as the elastic members, the center of the coil spring may be concentrically arranged with the center of the screw control.

One ends of the elastic members 371 and 373 may support a lateral surface of the bearing holder 310 which is located in an opposite side of the control screw 330 and the other ends of the elastic members 371 and 373 may be supported through a support rib 350 which is coupled to the second support frame 63 or is integrally formed with the second support frame 63. The elastic members 371 and 373 may elastically support the bearing holder 310 so that the bearing holder 310 may move to the P1 direction or the P2 direction in the rotation of the control screw 330.

An operation of the meandering adjustment member 300 will be described with reference to FIGS. 21 to 24. The meandering adjustment member 300 may be operated through the manual method like the meandering adjustment member 100.

For example, while the fixing belt 52 meanders to the non-driving side in running, as illustrated in FIG. 21, the bearing holder 310 which is screw-coupled to the control screw 330 may linearly move to the P1 direction in response to the control screw 330 being rotated to one direction. Accordingly, as illustrated in FIG. 22, the center axis A2 of the pressing roller 54 may move to the P1 direction.

In another example, while the fixing belt 52 meanders to the driving side in running, as illustrated in FIG. 23, the bearing holder 310 which is screw-coupled to the control screw 330 may linearly move to the P2 direction in response to the control screw 330 being rotated to a reverse direction of the one direction. Accordingly, as illustrated in FIG. 24, the center axis A2 of the pressing roller 54 may move to the P2 direction.

As described above, the user may determine whether the meandering of the fixing belt 52 advances to the driving side or the non-driving side of the fixing apparatus and may adjust the meandering of the fixing belt 52 by moving the center axis (or the rotation shaft 54*d*) of the pressing roller 54 through the control screw 330.

As described above, in response to the various meandering adjustment structures according to the embodiments being applied to the fixing apparatus, the washer-shaped sub bush used between the fixing belt and the bush may be omitted and the meandering of the fixing belt may be prevented in advance. Other than the fixing belt which is manufactured of a metal (for example, SUS) in the related art, the fixing belt manufactured of a synthetic resin material (for example, polyimide (PI)) may be used and thus material cost may be reduced.

The foregoing embodiments and advantages are merely and are not to be construed as limiting the disclosure. The teachings herein can be readily applied to other types of apparatuses. Also, the description of the embodiments of the disclosure is intended to be illustrative, and not to limit the scope of the claims, and many alternatives, modifications, and variations will be apparent to those skilled in the art.

Although embodiments have been shown and described, it would be appreciated by those skilled in the art that changes may be made to these embodiments without departing from the principles and spirit of the disclosure, the scope of which is defined in the claims and their equivalents.

The invention claimed is:

1. A fixing apparatus, comprising:

a fixing belt;

a pressing roller configured to press the fixing belt and to rotate the fixing belt;

a bush configured to guide an edge of the fixing belt; and a meandering adjustment member to support a rotational shaft of the pressing roller and to support a rotational movement to in response to the rotational movement, move a center axis of the rotation shaft of the pressing roller in a direction perpendicular to an axial direction of the fixing belt.

2. The fixing apparatus as claimed in claim 1, wherein the meandering adjustment member is disposed such that a rotation center of the meandering adjustment member is eccentric with respect to a center of the rotation shaft of the pressing roller.

3. The fixing apparatus as claimed in claim 2, further comprising a support frame configured to support the bush, wherein the meandering adjustment member is rotatably coupled to the support frame.

4. The fixing apparatus as claimed in claim 3, wherein the meandering adjustment member includes:

a rotation part rotatably coupled to a concave portion of the support frame, and having a portion in which a bearing configured to support the rotation shaft of the pressing roller is inserted, and a lever extending from the rotation part and including a locking protrusion coupleable to any one of a plurality of locking holes formed in the support frame, and the meandering adjustment member is configured to move the rotation shaft in a first direction by a clockwise rotation of the meandering adjustment member and to move the rotation shaft in a second direction which is a reverse direction of the first direction by a counter-clockwise rotation of the meandering adjustment member.

5. The fixing apparatus as claimed in claim 4, further comprising:

a gear coupled to the rotation part of the meandering adjustment member; and a motor configured to rotate in a forward direction and in a reverse direction so as to provide a rotation force to the gear.

6. The fixing apparatus as claimed in claim 5, further comprising a power transmission member configured to transmit the rotation force of the motor to the gear.

7. The fixing apparatus as claimed in claim 5, further comprising:

an identification unit disposed in at least one end portion of the fixing belt and having a first reflectance different from that of a second reflectance of a portion of the fixing belt which is configured to contact a printing medium in an image forming operation;

a photosensor configured to detect an amount of light radiated to the identification unit and reflected from the identification unit and to generate a detection signal based on the detected amount of light radiated to the identification unit and reflected from the identification unit; and a controller configured to compare the detection signal, received from the photosensor, with a preset permissible range and to control driving of the motor based on the comparison.

8. The fixing apparatus as claimed in claim 7, wherein the identification unit includes a pattern having the first reflectance.

9. The fixing apparatus as claimed in claim 8, wherein the pattern has at least one solid line or at least one dotted line.

10. The fixing apparatus as claimed in claim 5, further comprising:

a sensor unit including a photosensor disposed adjacent to the fixing belt and including a light-emitting unit and a light-receiving unit which face each other and are spaced apart from one another;

an actuator having a first end moveable to an initial position between the light-emitting unit and the light-receiving unit of the photosensor and a second end moveable to a position between the edge of the fixing belt and the bush;

an elastic member configured to elastically support the actuator; and a controller configured to control driving of the motor according to a detection signal of the sensor unit, wherein in response to the fixing belt moving toward the bush, the second end of the actuator is configured to receive a pressing force that moves the second end toward the bush to thereby allow the light-receiving unit to receive light from the light-emitting unit, and in response to a removal of the pressing force received by the second end of the actuator, the first end of the actuator is configured to move to the initial position via the elastic member to thereby prevent the light-receiving unit from receiving the light from the light-emitting unit.

11. The fixing apparatus as claimed in claim 5, further comprising:

an identification unit disposed in at least one end portion of the fixing belt and having a surface with a different height than a height of a surface of the fixing belt;

a sensor unit including a height sensor configured to detect a height difference between the surface of the fixing belt and the surface of the identification unit and to generate a detection signal based on the detected height difference; and a controller configured to compare the detection signal, received from the height sensor, with a preset permissible range and to drive the motor in response to the height difference being out of the preset permissible range and to stop the motor in response to the height difference being within the preset permissible range.

12. The fixing apparatus as claimed in claim 1, wherein the meandering adjustment member includes:

a bearing holder configured to support the rotation shaft of the pressing roller, and a control screw screw-coupled to one side of the bearing holder.

13. The fixing apparatus as claimed in claim 12, wherein the meandering adjustment member includes:

an elastic member configured to elastically support the bearing holder.

14. The fixing apparatus as claimed in claim 12, wherein a first end of the elastic member supports the bearing holder and a second end of the elastic member is supported by a structure disposed adjacent to the edge of the fixing belt.

15. An image forming apparatus, comprising:

a conveying device configured to convey a recording medium;

a developing device configured to develop an electrostatic latent image;

a transfer device configured to transfer the electrostatic latent image onto the recording medium;

a discharging device configured to discharge the recording medium; and a fixing device including:

a fixing belt, a pressing roller configured to press the fixing belt and to rotate the fixing belt, a bush configured to guide an edge of the fixing belt, and a meandering adjustment member to support a rotational shaft of the pressing roller and to support a rotational movement to in response to the rotational movement, move a center of axis of the rotation shaft of the pressing roller in a direction perpendicular to an axial direction of the fixing belt.

* * * * *